US006677918B2

(12) United States Patent
Yuhara et al.

(10) Patent No.: US 6,677,918 B2
(45) Date of Patent: Jan. 13, 2004

(54) LIGHT EMITTING DIODE DISPLAY SYSTEM

(76) Inventors: Yuji Yuhara, 6-5-111 Miyazaki, Miyamae-Ku, Kanagawa Prefecture (JP), 216-0033; Hiroyuki Kodama, 5-9-4 Harajuku, Totsuka-Ku, Yokohama City, Kanagawa Prefecture (JP), 245-0063

( * ) Notice: Subject to any disclaimer, the term of this patent is extended or adjusted under 35 U.S.C. 154(b) by 242 days.

(21) Appl. No.: 09/960,195

(22) Filed: Sep. 21, 2001

(65) Prior Publication Data

US 2003/0058191 A1 Mar. 27, 2003

(51) Int. Cl.[7] ..... G09G 5/00; G09G 3/20; G09G 3/22; G09F 7/00; G09F 15/00

(52) U.S. Cl. ..... 345/1.3; 345/55; 345/82; 345/903; 345/905; 40/452; 40/605; 40/606.01; 40/729; 40/730

(58) Field of Search ..... 345/1.1, 1.3, 4, 345/5, 55, 82, 903, 905, 32; 361/681, 683; 40/605, 606.01, 452, 729, 730

(56) References Cited

U.S. PATENT DOCUMENTS

| | | | | |
|---|---|---|---|---|
| 5,150,445 A | | 9/1992 | Toyoda et al. | |
| 5,428,365 A | | 6/1995 | Harris et al. | |
| 5,532,711 A | | 7/1996 | Harris | |
| 5,796,376 A | * | 8/1998 | Banks | 345/82 |
| 5,900,850 A | | 5/1999 | Bailey et al. | |
| 5,940,683 A | | 8/1999 | Holm et al. | |
| 5,956,003 A | | 9/1999 | Fisher | |
| 6,101,750 A | | 8/2000 | Blesener et al. | |
| 6,104,414 A | * | 8/2000 | Odryna et al. | 345/1.3 |
| 6,115,016 A | | 9/2000 | Yoshihara et al. | |
| 6,150,996 A | | 11/2000 | Nicholson et al. | |
| 6,169,632 B1 | * | 1/2001 | Kurtenbach et al. | 345/32 |
| 6,175,342 B1 | * | 1/2001 | Nicholson et al. | 345/1.3 |
| 6,262,696 B1 | * | 7/2001 | Seraphim et al. | 345/1.3 |
| 6,314,669 B1 | * | 11/2001 | Tucker | 40/605 |
| 6,362,801 B1 | * | 3/2002 | Yuhara | 345/82 |
| 6,370,019 B1 | * | 4/2002 | Matthies et al. | 345/55 |
| 6,543,164 B1 | * | 4/2003 | Sperl et al. | 40/605 |
| 2002/0126064 A1 | * | 9/2002 | Yen | 345/5 |

FOREIGN PATENT DOCUMENTS

| | | |
|---|---|---|
| GB | 2342487 A | 4/2000 |
| JP | 10-170055 | 6/1998 |
| WO | WO99/66482 | 12/1999 |

OTHER PUBLICATIONS

LED Curtain Flyer re LEC System Type I (Full Color LED Display Lighting System—Engineer Lighting, Inc. (same as above GB2,342,487A published on Apr. 12, 2000).

LEC LED Curtain Flyer re LEC System Type III.

* cited by examiner

*Primary Examiner*—Bipin Shalwala
*Assistant Examiner*—David L. Lewis
(74) *Attorney, Agent, or Firm*—Lackenbach Siegel LLP; Myron Greenspan

(57) ABSTRACT

LED image display system with rigid frames positioned in at least one vertical stack forming a planar vertical display, with vertical rigid bar members mounted to each of the frames and with equal spacing, and LED pixels mounted to each bar member. The pixels are equally spaced apart forming a matrix of pixels that project colored light beams. A rod bearing weight of the frames in tension is connected to each of the frames, and the rods have top and bottom connectors. Top connector of top frame is removably secured to an overhead support while bottom frame is spaced from stage or other surface. Bottom ring connector of weight-bearing rod of each stacked frame is removably connected to top hook connector of each below stacked frame. Each weight-bearing rod includes rod portions threadably connected to a turnbuckle for tightly positioning all adjoining frames of the stack; and system includes controls receiving video signals and processing same as either still color images and/or color animated images.

41 Claims, 18 Drawing Sheets

LIGHT EMITTING DIODE DISPLAY SYSTEM

FIELD OF THE INVENTION

The present invention relates to a light emitting diode (LED) display system for large-scale displays.

BACKGROUND OF THE INVENTION

LED display systems used for large-scale merchandising, architectural, stage, and theatrical displays are known in the art of luminance. Such displays, also known as curtain displays, which typically are viewed by an audience at a distance of more than 50 meters, require a large and complex support structure to hold the LEDs. A plurality of LEDs mounted on such a display support structure are arranged in a grid, or matrix, at geometrically predetermined positions. The LED luminescence is projected to viewers as images in response to signals received in accordance with data sent from a controller. LED luminescence can be projected in the full color spectrum as still images or as animated images. The support structures for the LEDs generally used for large-scale displays are made of rigid metal materials that are heavy and as such are difficult to handle. In addition to the physical problems of transportation, assembly and disassembly, the time needed for erection of such displays becomes yet another problem factor. The heavy structure presently required for large scale LED stage displays often requires that existing stage support structure be reinforced, which increases the time and cost of installation.

Large-scale LED display systems that have responded to the problems set forth above are as follows:

A) U.S. Pat. No. 5,900,850 issued to Bailey et al. on May 4, 1999, discloses a large scale, portable, image display system that includes a plurality of panels with each panel comprising a web structure formed of a plurality of spaced flexible strap members that extend vertically between the top and bottom sides of each panel and a plurality of spaced flexible strap members extending generally horizontally connected to the vertically extending strap members. A plurality of LEDs are mounted on the strap members at predetermined spaced positions to form a matrix of diode light sources for projecting an image. The panels are interconnected and are connected to a support member.

Although Bailey asserts that the display system projects animated images, it is self-evident that the flexible strap members are limited in capability to project animated images with the predetermined precision required. Nylon is suggested as a strap material. It is particularly self-evident that no amount of tensioning is capable of creating a substantially planar surface. The horizontally extending strap members are particularly subject to sagging and distortion however slight with a significant loss of the precision required particularly for animated imagery. In an outdoor environment particularly wind would be expected to be a negative factor. Also heat and rain would also be expected to affect the straps. Claim 1 of Bailey sets forth a "generally horizontally extending strap members' when other strap members are "extending vertically." FIG. 4 therein shows tensioning means for the vertical straps only with the horizontal straps being permanently secured to the vertical straps. Even with the questionable assumption that the vertical straps can be tensioned to the extent that the diodes affixed to one vertical strap cannot shift however slightly relative to the diodes affixed to other vertical straps, it is difficult further to assume that the diodes affixed to one of the horizontal straps cannot significantly shift relative to the diodes affixed to the other horizontal straps and in fact relative to the diodes affixed to the vertical straps.

B) Examples of such lightweight net, or mesh, support structure that mounts LEDs for large-scale luminance display that can be assembled and disassembled rapidly are known. References to this net support structure are as follows:

1) Japanese Application No. 10-170055 filed Jun. 17, 1998, and its counterpart published WO 99/66482 Japan on Dec. 23, 1999.

The LED flexible net support structure described above has advantages over the heavy and difficult to erect and transport LED rigid assembly boards. One advantage of the LED net display mount is that it is light in weight and thus is relatively easy to transport, assemble and disassemble. Another advantage of the LED net display is its flexibility so that it can be easily curved when mounted in position for illumination display. Another advantage is that objects positioned behind the display net can be seen by observers through the apertures in the net so that such objects can be illuminated in various ways simultaneous with image illumination by the mounted LEDs.

A major disadvantage of a net-type LED display structure is that it is difficult to precisely position the individual LED pixels so that each LED beam projects in unison with all other LED beams in a required direction in response to data signals received from a controller. Such difficulty in exact performance technique is compounded when animation illumination is desired.

Other inventions that relate to the field of LED display systems, are as follows:

1) U.S. Pat. No. 5,150,445 issued to Toyoda et al. on Sep. 22, 1992;
2) U.S. Pat. No. 5,428,365 issued to Harris et al. on Jun. 27, 1995
3) U.S. Pat. No. 5,532,711 issued to Harris on Jul. 2, 1996
4) U.S. Pat. No. 5,940,683 issued to Holm et al. on Aug. 17, 1999;
5) U.S. Pat. No. 5,956,003 issued to Fisher on Sep. 21, 1999;
6) U.S. Pat. No. 6,101,750 issued to Blesener et al. on Aug. 15, 2000;
7) U.S. Pat. No. 6,115,016 issued to Yoshihara et al. on Sep. 5, 2000; and
8) U.S. Pat. No. 6,150,996 issued to Nicholson et al. on Nov. 21, 2000;

BRIEF SUMMARY OF THE INVENTION

It is an object of the present invention to provide a large-scale LED display that is lightweight and easily transported, assembled and disassembled and that can support a large number of LED pixels that project the full color spectrum in an animation display.

It is a further object of the present invention to provide a large-scale lightweight LED display that comprises a plurality of frames supporting a number of LEDs that can be easily transported and assembled and disassembled in a short time and that can project full color animation illumination displays in accordance with video input signals.

It is another object of the present invention to provide a large-scale lightweight LED display that can be easily assembled and can be seen through so that objects or persons behind the display can be seen by observers of the LED display so that various stage effects in addition to the animation displays are possible.

In accordance with these objects and other objects that will become apparent in the course of this disclosure, there is provided a large-scale light emitting diode (LED) image display system positioned on a surface such as a stage comprising a plurality of rigid frames positioned in at least one vertical stack so as to form a planar vertical display. A plurality of vertical rigid bar members are mounted to each of frames the bar members being equally spaced apart with a plurality of LED pixels being mounted to each of the bar members. The pixels are equally spaced apart so as to form a matrix of pixels. The LED pixels project colored light beams defining images. A rod for bearing the weight of the frames in a tension mode is connected to each of the frames. The weight-bearing rods have a top connector and a bottom connector. The rod top connector of the top frame is removably secured to an overhead support while the bottom frame is spaced from the surface. A bottom ring connector of the weight-bearing rod of each stacked frame is removably connected to a top hook connector of each adjoining stacked frame. Each of the weight-bearing rods are threadably connected to a turnbuckle so as to tightly position all adjoining frames of the stack. Included are controls for receiving external video signals and processing the signals as either still images and animated images in color.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention and what is presently considered and believed to be the best mode of practice in the principles thereof.

Other embodiments or modifications may be suggested to those having the benefit of the teachings therein, and such other embodiments or modifications are intended to be reserved especially as they fall within the scope and spirit of the subjoined claims.

DETAILED DESCRIPTION OF THE INVENTION

Figure 1:
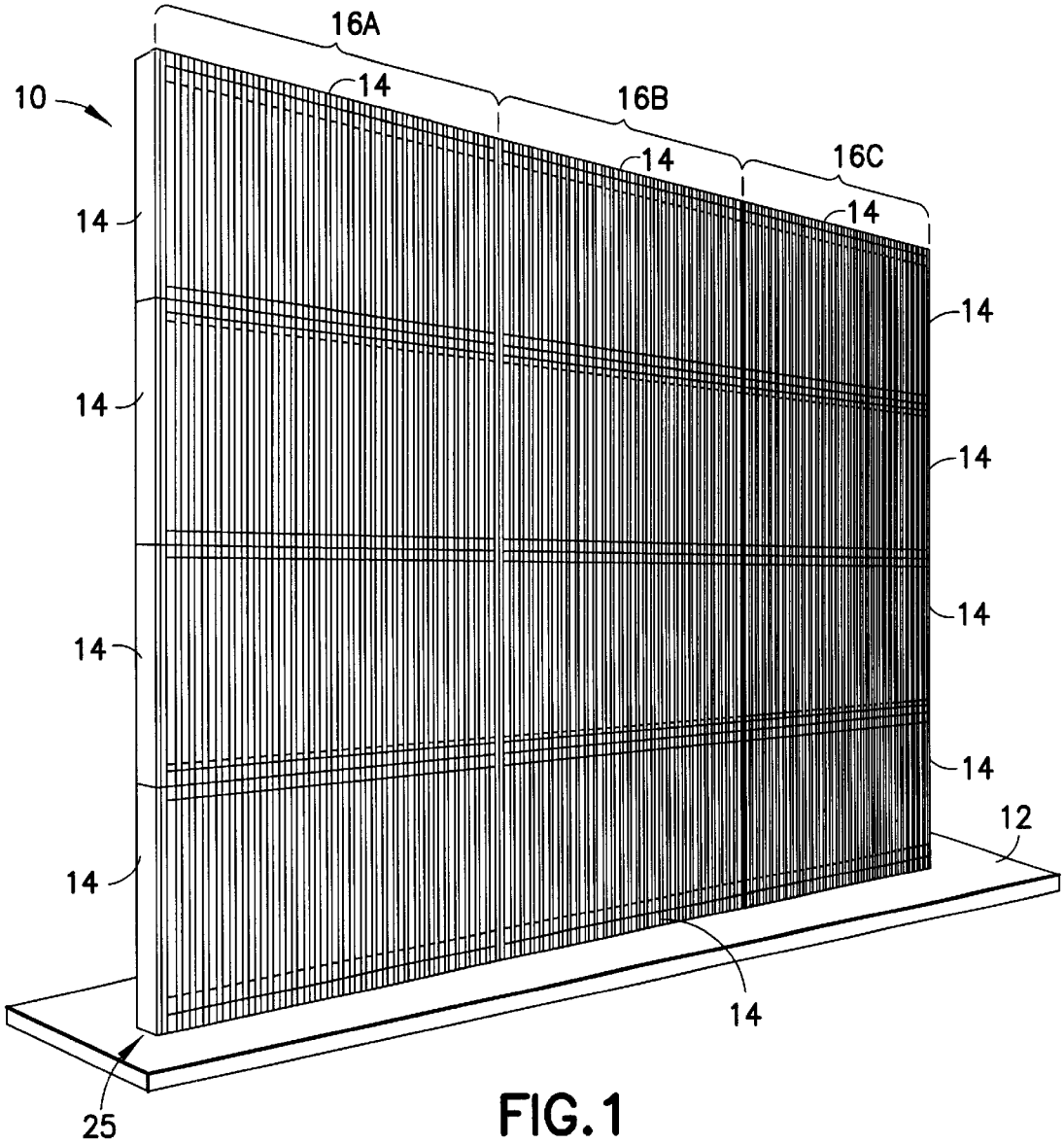
FIG. 1 is a perspective frontal view of a complete matrix LED display that includes three vertical columns, or stacks, of four frames for each stack for a total of 12 frames with each frame including spaced vertical bars mounting colored LED pixels.

Reference is now made to the drawings and in particular to FIGS. 1–14D in which identical or similar parts are designated by the same reference numerals throughout.

A simplified light emitting diode (LED) display system 10 shown in FIG. 1 is positioned in a vertical plane adjacent to a stage surface 12 for projection of still images or animated images for a visual display to an audience. Display system 10 includes 12 separate rectangular frames 14 that are joined together and in particular are arranged in four vertical frame stacks 16 each comprising three frames 14. Display system 10 is rectangular in configuration. Display system 10 is positioned for illuminated display to an audience generally at least 50 meters away. Display system 10 is applicable for use as an entertainment display, a stage display, an architectural display, a merchandising display, and the like.

Figure 2:
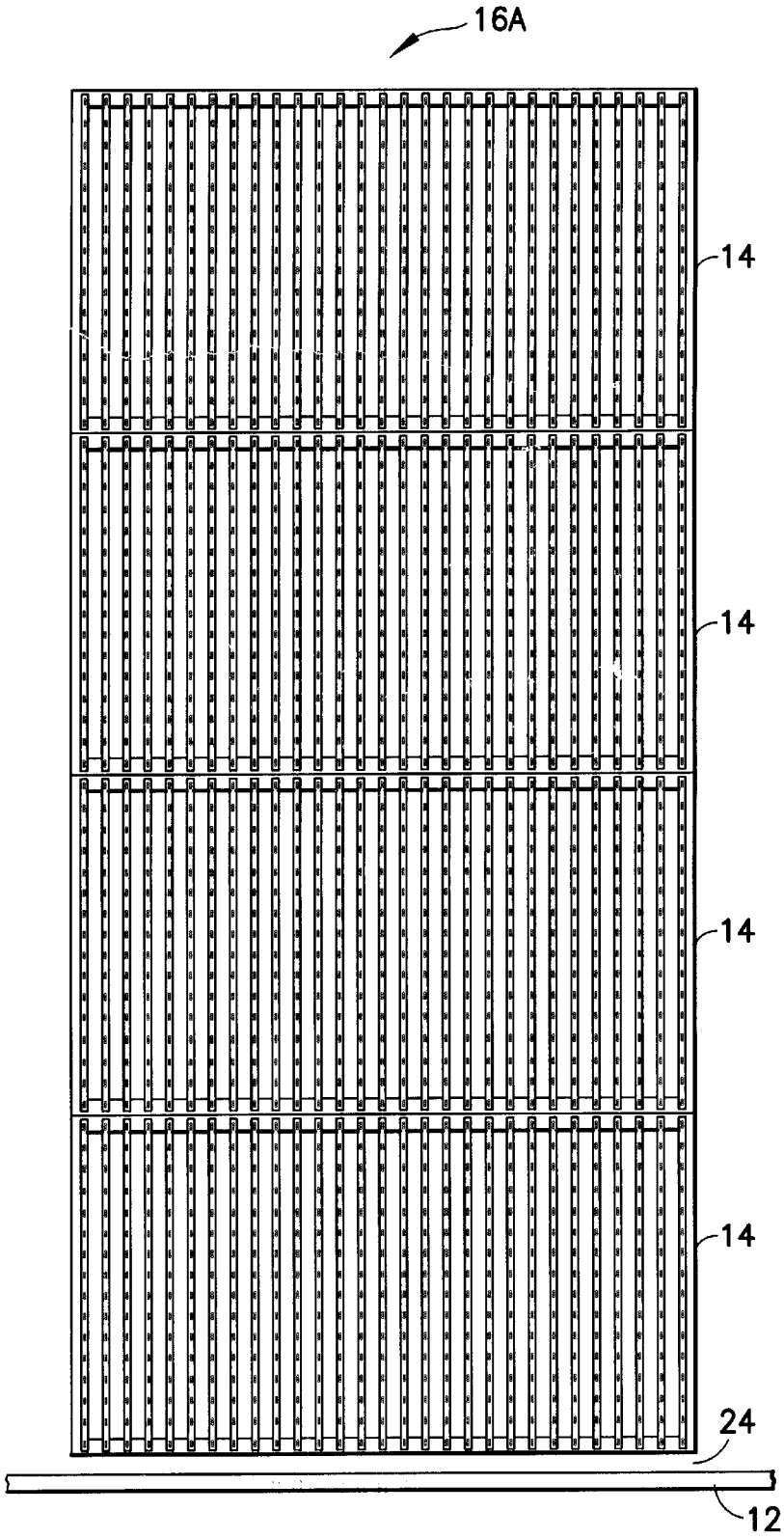
FIG. 2 is a frontal view of a single stack of 4 frames taken in isolation of the 12 frames of the matrix LED display shown in FIG. 1.

A frontal view of frame stack 16A, which is also representative of frame stacks 16B and 16C, is shown in isolation in FIG. 2. A single frame 14 randomly selected from any of frame stacks 16A, 16B and 16C shown in FIGS. 1 and 2 is shown in isolation in FIG. 3. Each frame 14 includes a horizontal frame flat top side 18 and an opposed horizontal flat frame bottom side 20 and a pair of opposed vertical frame sides 22 joined to frame top and bottom sides 18 and 20 that together define a rectangular space 24. Frame top and bottom sides 18 and 20 and frame sides 22 are thin and flat and are made of a thin, rigid, lightweight material such as a metal so that the entire frame is very lightweight. Such metals can include aluminum, magnesium, beryllium or other lightweight metals. In addition, plastic, fiberglass, carbonaceous materials and other lightweight materials and combinations thereof can be used. Laminated materials comprising a combination of lightweight materials and/alloys can also be used.

Figure 3:
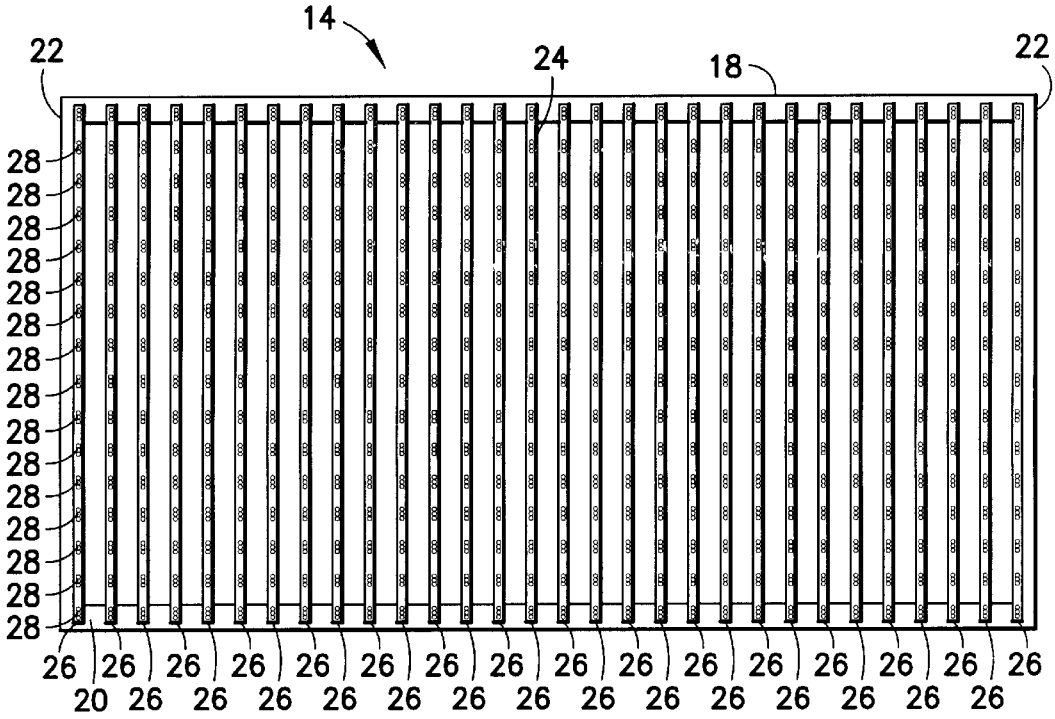
FIG. 3 is a frontal view of a single frame taken in isolation of any of the frames shown in FIGS. 1 and 2.
Figure 4A:
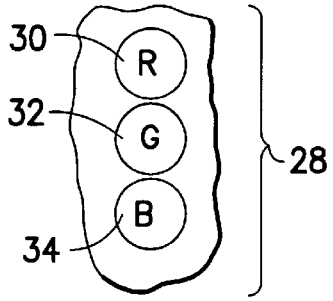
FIG. 4A is a detailed frontal view that shows on one of the pixels shown in FIG. 5 comprising three colored LEDs.
Figure 4B:
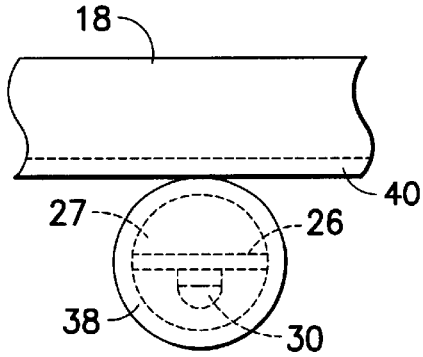
FIG. 4B is a view taken through line 4B—4B of FIG. 4.
Figure 4C:
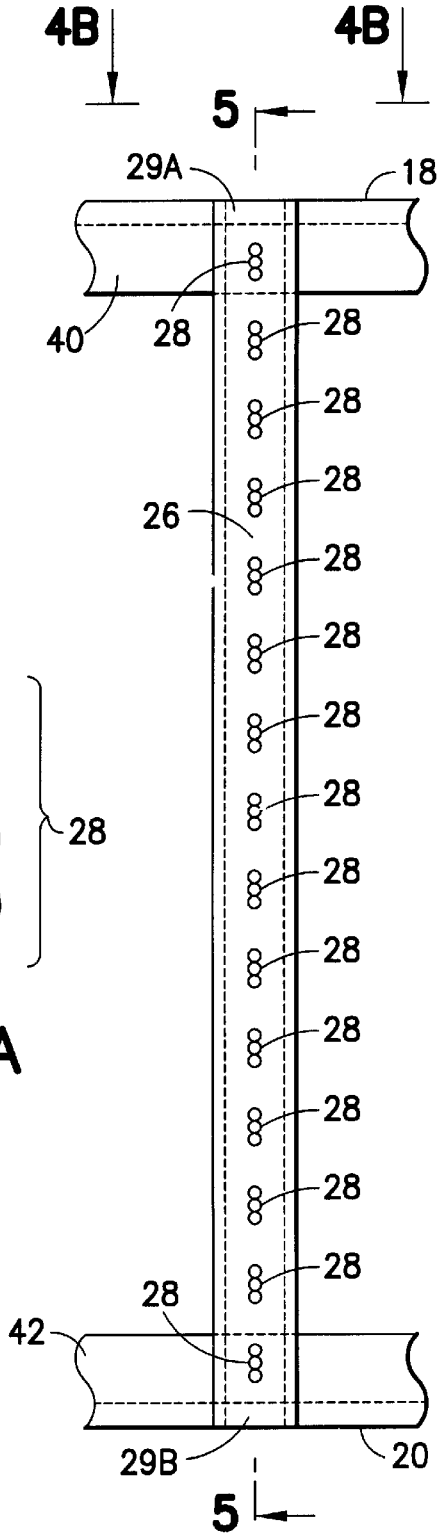
FIG. 4 is a frontal view of a single LED bar taken in isolation holding 16 LED pixels.
Figure 5:
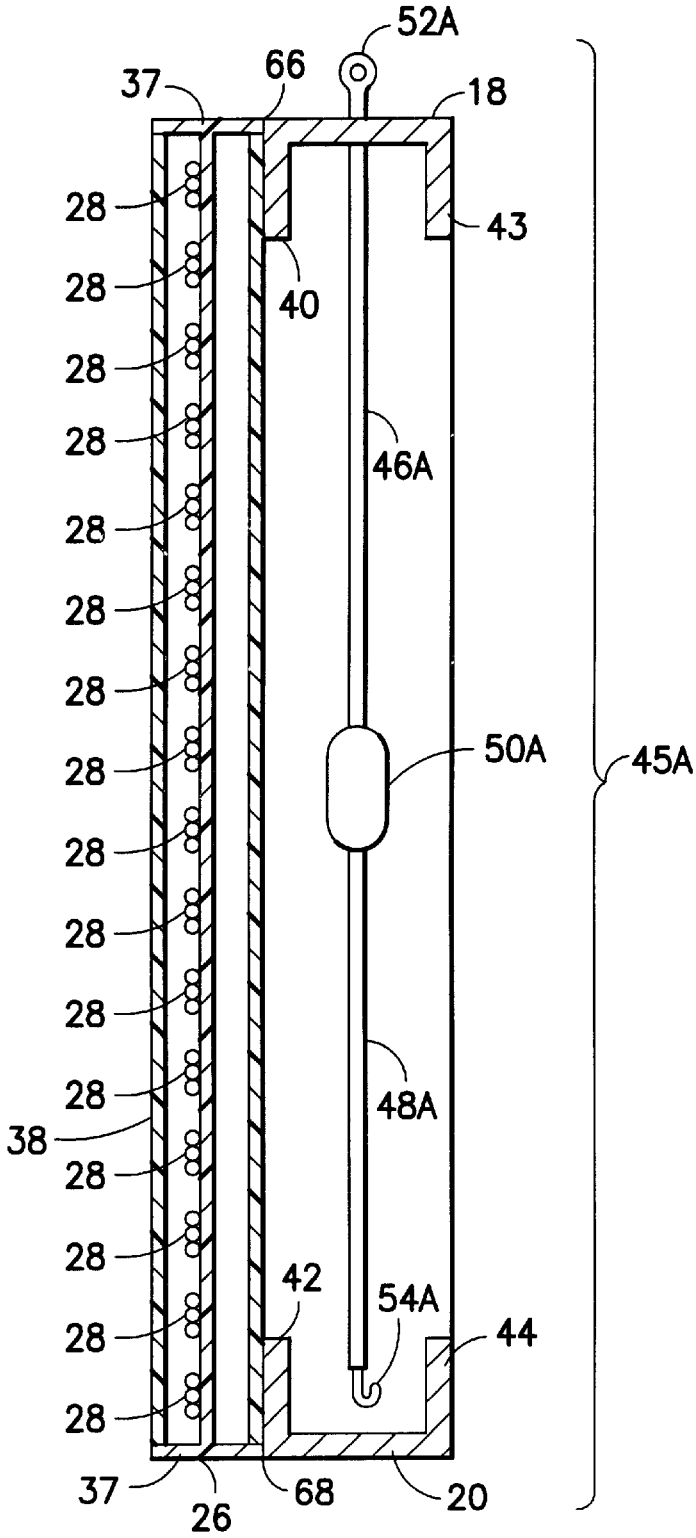
FIG. 5 is a view taken through line 5—5 in FIG. 4.
Figure 6:
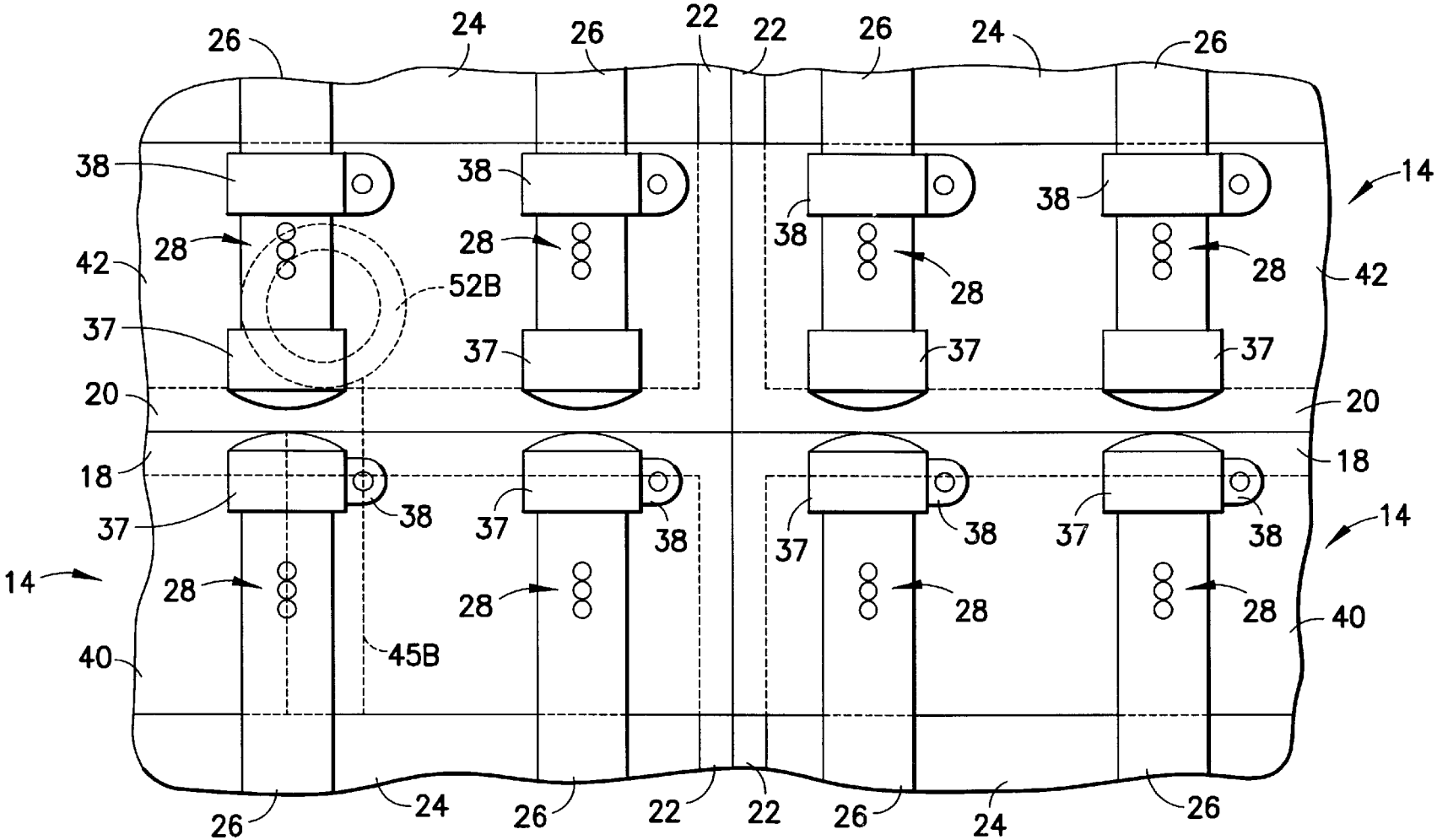
FIG. 6 is a detail front view of two stacked frames adjoining another two stacked frames that shows details of the end caps of the diode protective tubes and of the connecting straps of the tubes.

Each frame 14 as shown in FIGS. 1 and 2 and as particularly observable in FIG. 3 and also shown in detail in FIGS. 4, 5 and 6 supports 30 vertical rigid pixel support bars 26 that are positioned in vertical columns at equal intervals and in horizontal rows at equal intervals across space 24. A single pixel support bar 26 shown in isolation in FIG. 5 mounts 16 pixel support bars 26 in a manner known in the art.

As seen in FIGS. 4 and 5, each pixel support bar 26 includes top and bottom ends 29A and 29B, respectively, that are secured to frame top and bottom sides 18 and 20, respectively. Pixel support bars 26 are equally spaced one from the other not only within each frame 14 but are equally spaced from one another throughout a display such as display 14. In addition, all pixels 28 are equally spaced from each vertically adjoining pixel 28 not only on each pixel support bar 26 but are equally spaced apart from one another at each vertically aligned support bar 26 located both above and below vertically adjoining support bars 26. Thus, pixels 28 form a matrix of equally spaced pixels 28 defined in vertical columns and horizontal rows.

As shown in FIGS. 4 and 4A each pixel 28 comprises a red (R) LED 30, a green (G) LED 32 and a blue (B) LED 34 that are closely positioned so as to define a single RGB pixel 28. RGB pixels 28 can reproduce any of the colors of the visible spectrum including white and black as instructed by electrical signals. The matrix of pixels 28 are arranged in a vertical plane and project variously colored light transverse to the vertical plane. A suggested pixel data for each RGB LED diode for each pixel 28 is 8 and a suggested color separation of each pixel 28 is approximately 1600 colors, but such data can vary. The primary colors red, green, and blue of RGB LEDs can be mixed to produce the secondary colors cyan, yellow, magenta (CYM), and also white light. Mixing green and blue gives cyan, as is known in the art of colors. Likewise as is known in the art, mixing green and red gives yellow. Mixing red and blue gives magenta. Mixing red, green, and blue together results in white.

Each of the 16 individual pixels 28 receive signals from a master computer 35 (FIGS. 8 and 12) by way of cables mounted to frames 14 connected to individual circuits printed on the front and rear sides of each pixel support bar 26 in a manner known in the art.

As shown in FIGS. 4, 4B, 5 and 6, which shows two vertically positioned frames 14 adjoining another two vertically positioned frames an elongated transparent cylindrical plastic tube 36 mounted to each pixel support LED bar 26 encloses and seals pixels 28 so as to protect pixels 28 from water and other contamination. As seen in FIGS. 4 and 5, top and bottom end caps 37 are mounted at the top and bottom ends 29A and 29B of transparent tubes 36 to completely seal the interior of tubes 36. As seen in FIG. 6, mounting straps 38 encircle transparent tubes 36 at two positions, one proximate to each frame top side 18 and the other proximate to each frame bottom side 20. Straps 38 are riveted to frame top and bottom front flanges 40 and 42. Mounting straps 38 are slightly spaced above the bottom caps of end caps 37. Mounting straps 38 also encircle the top caps of end caps 37 that are proximate to frame top sides 18. Straps 38 are secured to frame top front flanges 40 and frame bottom front flanges 42 by rivet connectors.

Figure 7:
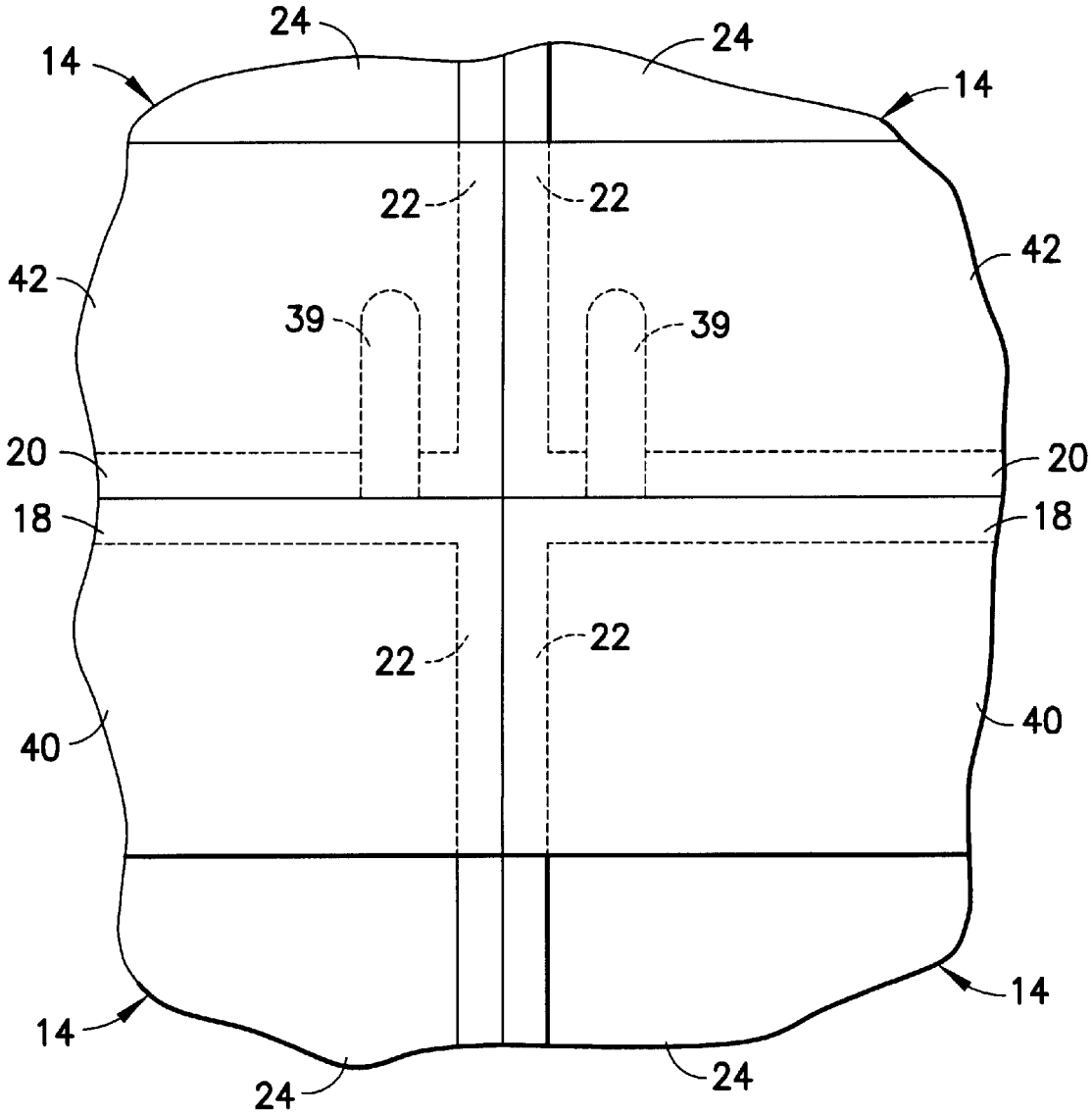
FIG. 7 is a detail simplified front view of two stacked frames adjoining another two stacked frames that shows in isolation alignment pins between upper and lower frames.

FIG. 7, which is a simplified detail view of the 4 frames shown in FIG. 6, shows upwardly extending cylindrical alignment pins 39 connected to each top front flange 40 proximate to each side flange 42 so that each frame 14 in fact includes two alignment pins 39. Alignment pins 39 extend through circular apertures defined in each frame bottom side 20 of frames 14. Pins 39 lock stacked frames 14 in vertical alignment.

Figure 8:
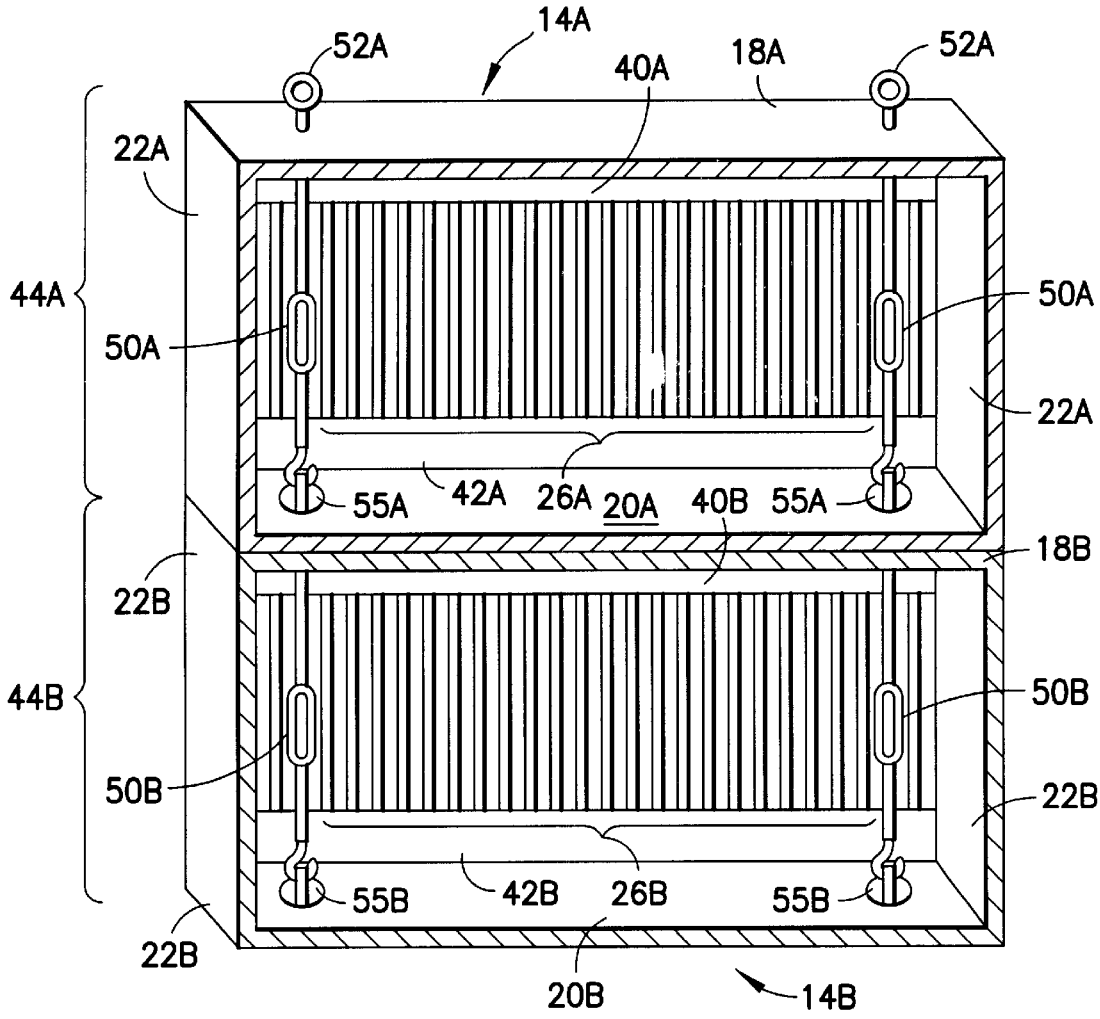
FIG. 8 is a sectioned perspective rear view of two frames stacked vertically such as shown in FIGS. 1–3 with the section taken on a vertical plane so that the rear upper and lower flanges and the side flanges are removed, the view also showing the upper and lower vertical support rods for each frame each rod including a turnbuckle.

As seen in sectioned rear view in FIG. 8, which shows the interior of frames 14A and 14B, two exemplary upper and lower frames 14A and 14B, respectively, selected for the purpose of exposition from any two stacked frames 14 shown in FIGS. 1 and 2 are positioned in a vertical column, or stack, with upper frame 14A being positioned a top lower frame 14B. Upper frame 14A includes opposed frame top and bottom sides 18A and 20A, respectively, connected to opposed frame sides 22A. Lower frame 14B includes opposed frame top and bottom flat sides 18B and 20B, respectively, connected to opposed frame sides 22B. In the stacked mode shown in FIG. 4, frame bottom side 20A of upper frame 14A is exactly positioned in alignment with frame top side 18B of lower frame 14B. Frame sides 22A of upper frame 14A are exactly aligned with frame sides 22B of lower frame 14B.

As best seen in FIGS. 4, 5 and 6, 30 vertical pixel support bars 26 are connected to top and bottom front flanges 40 and 42, respectively, that are connected at right angles to frame top and bottom sides 18 and 20, respectively, of frames 14. In particular, pixel support bars 26 are connected to frame top and bottom front flanges, 40A and 42A of frame top and bottom sides 18A and 20A, respectively, of upper frame 14A. In the same manner, 30 pixel support bars 26 are connected in a manner known in the art to top and bottom front flanges 40B and 42B, respectively, of frame top and bottom sides 18B and 20B, respectively, of lower frame 14B. Flanges 40A and 42A are connected at right angles with frame top and bottom sides 18B and 20B. Also, as seen in FIG. 5, a typical rear flange 43 is connected at right angles to each typical frame flat top side 18 and a typical rear flange 44 is connected at right angles to each typical frame flat bottom side 20.

Figures 9, 9A:
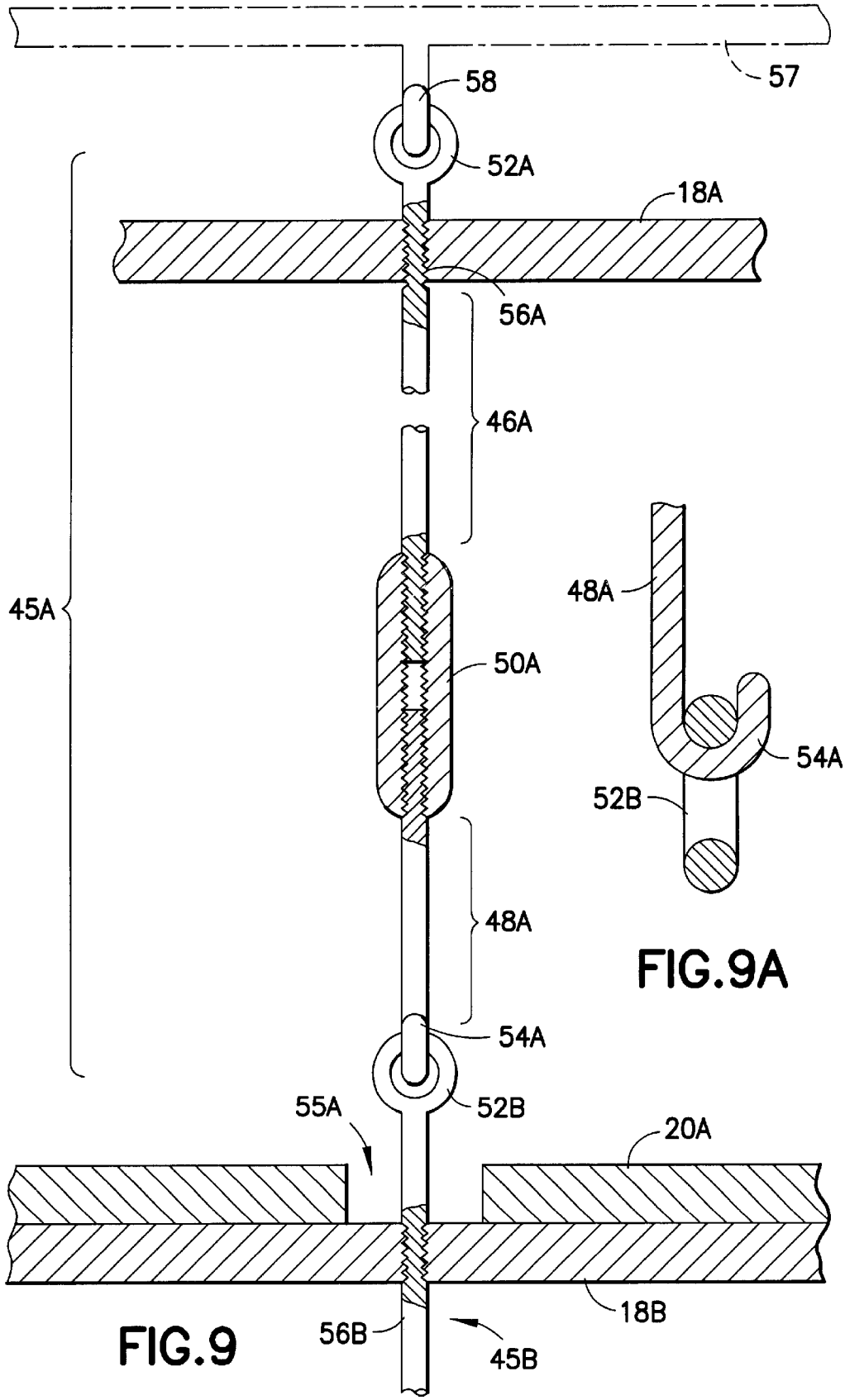
FIG. 9 is a detailed sectioned frontal view an upper frame and a lower frame such as shown in FIG. 4 removably and adjustably connected by upper and lower support rods with the upper rod being interconnected by a turnbuckle.
FIG. 9A is a detailed sectioned view of the hook and ring connectors shown in FIG. 9.

FIGS. 9 and 9A shows in detail a typical support rod 45A that is also shown mounted in association with upper frame 14A in FIG. 4. FIG. 4 further shows two spaced apart exemplary vertical weight-bearing upper support rods 45A associated with upper frame 14A and two spaced apart exemplary vertical weight-bearing lower support rods 45B associated with lower frame 14B. FIG. 7 also indicates a portion of lower support rod 45B. Typical upper support rod 45A is spaced from frame side 22A of upper frame 14A as seen in FIG. 4, and likewise lower support rods 45B are spaced from frame side 22B of lower frame 14B.

Typical support rod 45A of frame 14A is exemplary of all support rods of frames 14 herein. Typical support rod 45A includes a rod top portion 46A and a rod bottom portion 48A. Lower support rod 45B includes a rod top portion 46B and a rod bottom portion 48B.

Rod top portion 46A and rod bottom portion 48A are threadably joined by a turnbuckle 50A so that the distance between rod top portion 46A and rod lower portion 46A can be varied by screwing and unscrewing each relative to turnbuckle 50A. The top end of rod top portion 46A has a connecting ring 52A integrally connected thereto. Turnbuckle 50A has the function of tensioning upper support rod 45A so as to tightly fasten together all adjoining frames 14 of stack 16A, particularly frame bottom side 20A of frame 14A with frame top side 18B of frame 14B as shown in FIGS. 4 and 7. Turnbuckles of frames 14 typified by turnbuckle 50A have the tensioning function of drawing the stacked frames together into tight juxtaposition.

The bottom end of rod top portion 46A is screwed into turnbuckle 50A. The bottom end of rod lower portion 48A includes a connecting hook 54A. The top end of rod lower portion 48A is screwed into turnbuckle 50A. Rod top portion 46A is secured to frame top horizontal side 18A of upper frame 14A at threads 56A with connecting ring 52A being located over and proximate to frame top side 18A. In summary, typical support rod 45A comprises rod top portion 46A, connecting ring 52A, turnbuckle 50A, rod bottom portion 48A and hook 54A. Lower support rod 45B is analogous to upper support rod 45A and comprises rod top portion 46B, connecting ring 52B, turnbuckle 50B, rod bottom portion 48B and hook 54B.

FIG. 9 shows in phantom line a support truss 57 shown including a downwardly extending truss hook 58. Connecting ring 52A of top support rod 45A is removably connected to truss hook 58. Weight-bearing top and bottom support rods 45A and 45B bear the weight of both upper and lower frames 14A and 14B in a tension mode with the ultimate weight being borne by truss 57.

A single frame 14 represents a basic mode of the structure of the present invention and the principle of at least one pair of typical weight-bearing support rods 45A that include a pair of connecting rings 52A removably connected to truss hook 58 or an analogous support structure so that the weight of a single frame 14 is supported by the pair of support rods 45A. The single frame 14 can be expanded to include a plurality of frames 14 such as the two frames 14A and 14B shown in FIGS. 8 and 9 and further can be expanded to a single stack of frames 14 such as one of frame stacks 16A, 16B, or 16C of LED display 10 shown in FIGS. 1 and 2 and yet further expanded to include a plurality of vertical frame stacks beyond the three stacks 16A, 16B, 16C shown in FIG. 1 and still further expanded to include a plurality of frames 14 in a plurality of single stacks having more that three frames, for example, four or five frames. Weight-bearing support rods 45A and 45B shown in FIG. 8 and in part in FIG. 9 represent analogous weight-bearing support rods that extend vertically through each of frame stacks 16A, 16B and 16C as seen in FIG. 1. (Weight-bearing support rods not shown therein.)

Figure 10:
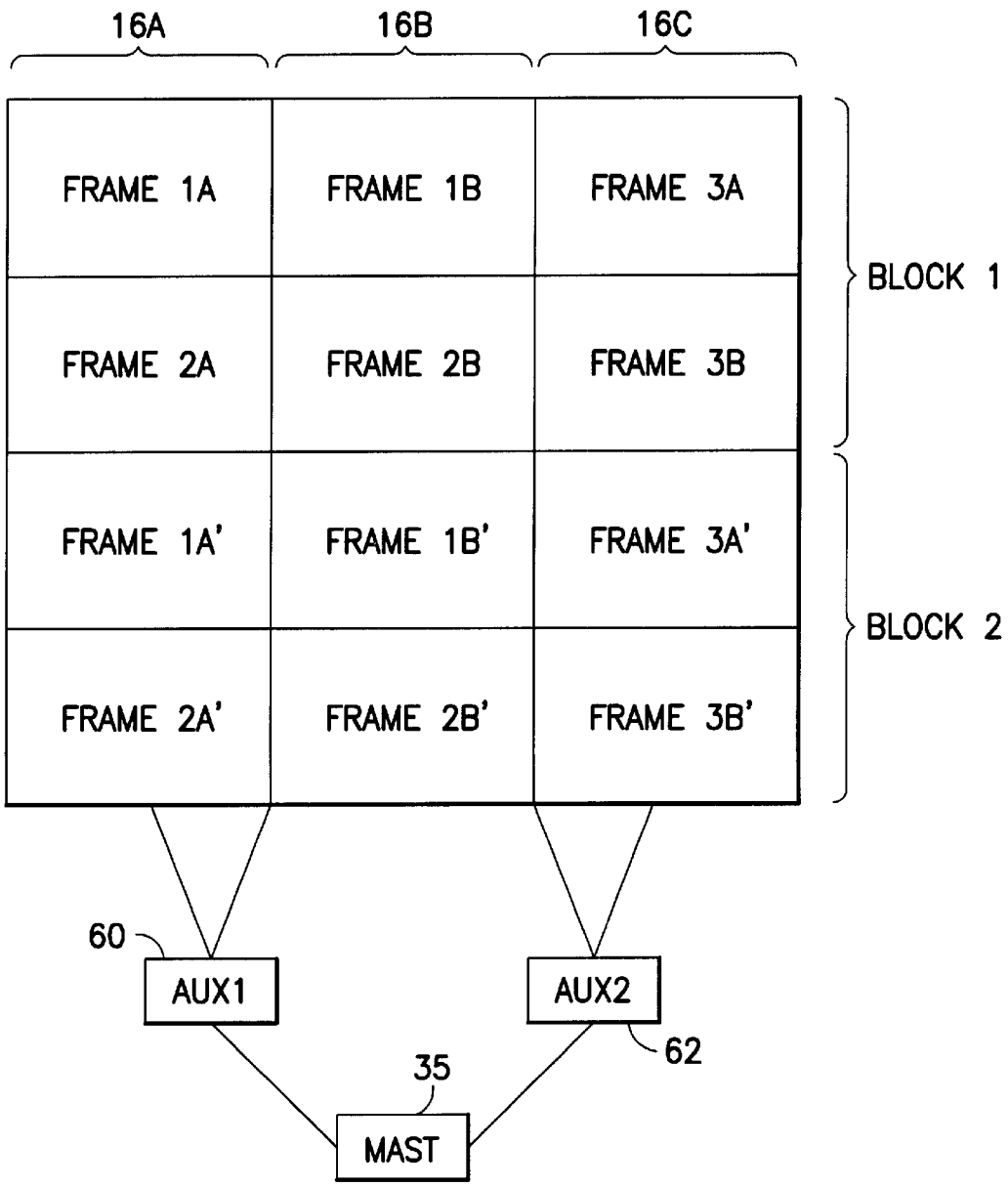
FIG. 10 is a schematic diagram that includes the 12 frames shown in FIG. 1 that are connected to two auxiliary computers in turn operatively connected to a master computer that controls either a still or an animated LED color display and further indicating two electrical blocks of the six frames each.

FIG. 10 is a schematic diagram that includes twelve frames 14 comprising LED display system 10 shown in FIG. 1. Frame stack 16A comprises top frame 1A mounted atop frame 2A in turn mounted atop frame 1A' that is mounted atop frame 2A' all interconnected by support rods as exemplified by typical support rod 45A as shown in FIG. 7. Frame stack 16B comprises top frame 1B mounted atop frame 2B in turn mounted atop frame 1B' that is in turn mounted atop frame 2B'. Frame stack 16C comprises top frame 3A mounted atop frame 3B in turn mounted atop frame 3A' that is in turn mounted atop frame 3B'. In assembling display system 10, typical frame stack 16A is assembled as follows: frame 1A is hung from an overhead support such as truss 57 shown in FIG. 9 by way of truss hook 58 (as shown in FIG. 7), frame 2A is hung from frame 1A in the manner shown in FIGS. 4, 7 and 7A, frame 1A' is hung from frame 2A in an analogous matter, and bottom frame 2A' is hung from frame 1A' in an analogous manner. Further, frames 1A, 1B, frames 2A, 2B, and frames 3A, 3B form electrical block 1; and frames 1A', 1B' and frames 2A' and 2B' and frames 3A', 3B' form electrical block 2 as shown in FIG. 10. Frame bottom sides 20 of bottom frame 2A', bottom frame 2B', and bottom frame 3B' are generally closely aligned with a support surface such as surface 12 shown FIG. 1 leaving a slight space 25 shown in FIGS. 1 and 2 existing between frame bottom sides 20 of the bottom frames and surface 12. Space 25 can be a small distance, but display 10 can be hung from a truss that is comparatively high so that the distance between the bottom frames and surface 12 as indicated by space 25 can vary in accordance with particular conditions.

Figure 11:
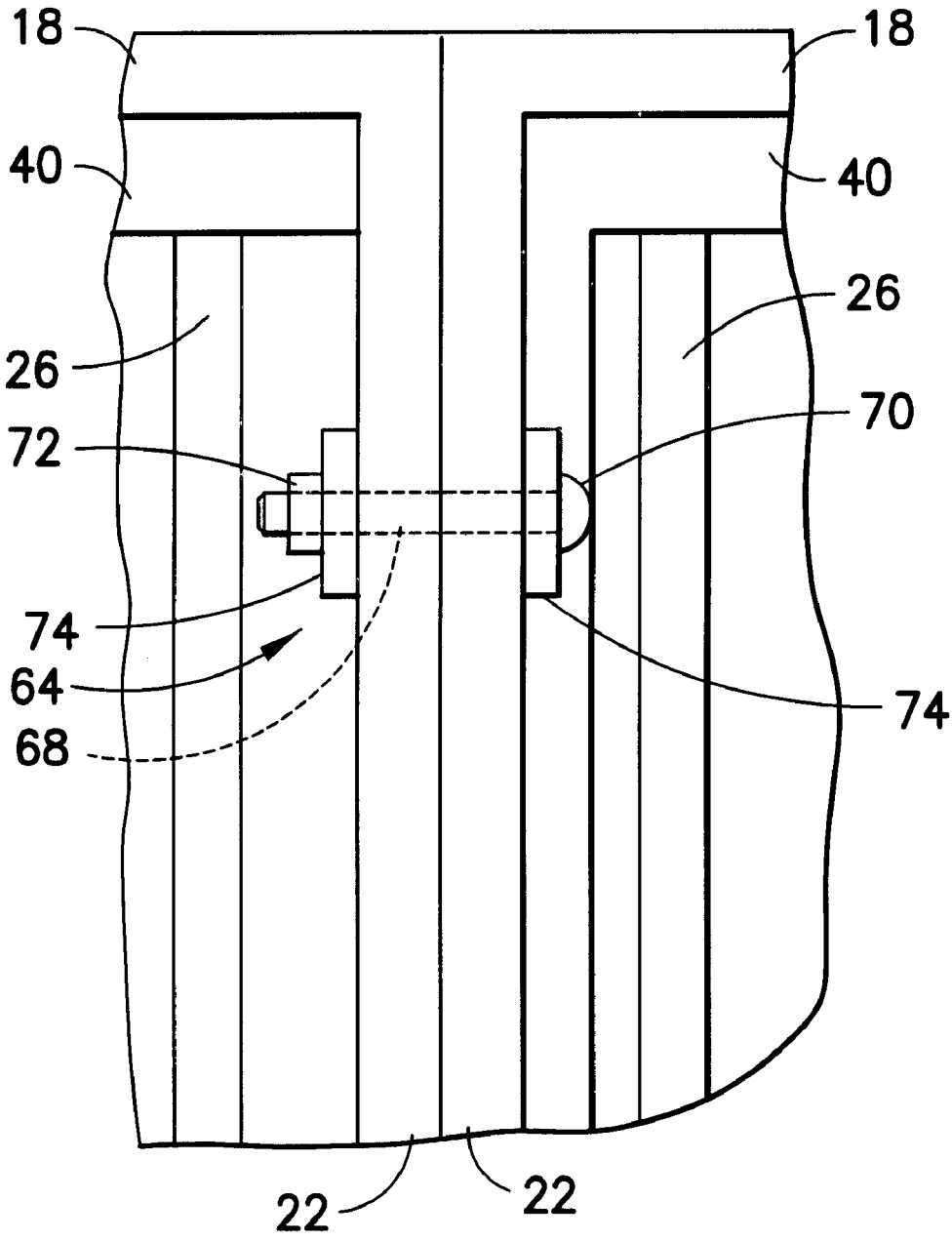
FIG. 11 is an isolated detail rear view of two adjoining frames held together by a clamp.

FIG. 11 shows two exemplary adjoining frames 14 taken from any of the stacked frames shown herein such as frame 1A and frame 1B, or frame 1B and frame 3A or any of the adjoining frames shown in FIG. 10. Each stack of frames 16A, 16B and 16C are kept in relationship with one another by side clamps such as side clamp 64 shown in FIG. 11. Adjoining frame sides 22 of each frame 14 proximate frame top side 18 each define a horizontal circular aperture 66 through which extends a horizontal locking bolt 68 having a screw head 70 and an opposed nut 72. Locking washers 74 are positioned between nut 72 and one frame side 22 and between screw head 70 and one frame side 22 and between nut 72 and the adjoining frame side 22. Frames 14 preferably include side clamps 64 at frame bottom side 20 or at further locations such as midway between frame top and bottom sides 18 and 20. Other types of clamping devices known in the art can be substituted for side clamp 64, such as U-shaped locking clamps.

Master computer 35 controls the animated LED color display projected by the matrix of LED pixels 28 supported by the totality of 12 frames that comprise LED display system 10. Master computer 35 is operatively connected separately to auxiliary, computers 60 and 62 that in turn are operatively connected to the electrical connectors to pixels 28 so as to send signals to the LED color display as either still images or as animated images that is viewed by the audience.

Figure 12:
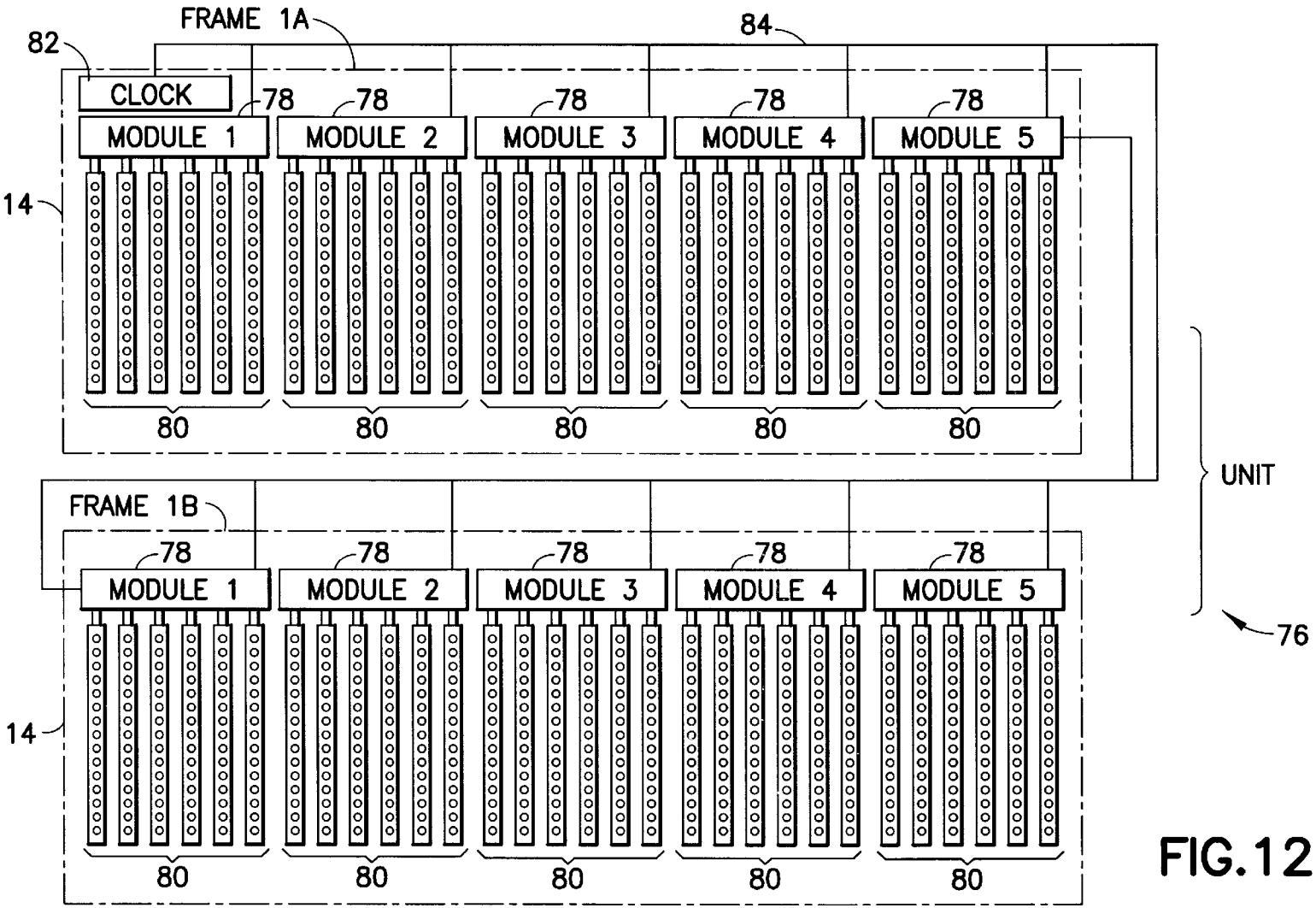
FIG. 12 shows in detail the LED modular scheme of a two frame unit of the frames shown in FIG. 10 with each frame indicated in phantom line.

FIG. 12 shows an abstractly presented typical electrical operational unit 76 exemplified by two typical frames 14 indicated as frame 1A and frame 1B each shown in phantom line. Frame 1A and frame 1B are analogous to frame 1A and frame 1B in FIG. 12. The electrical system between frame 1A and frame 1B is independent of the physical relationship between frame A and frame B. Unit 76 includes an electrical configuration of frame 1A and of frame 1B such that each frame supports five sets of LED communication boards 78 that each include six LED modules 80 for a total of five LED modules indicated in FIG. 12 as LED module 1, 2, 3, 4 and 5. Thus, a total of 30 equally spaced LED support bars 26 are positioned by frame 1A and also by frame 1B. Each LED module 80 comprises six vertical LED support bars 26 each mounting 16 RGB pixels 28 such as shown in FIG. 4 for a total of thirty pixel bars 26 for each frame 14 exemplified by frame 1A and by frame 1B. Electrical conductors pass signals from master computer 35 to LED modules 1–5 by cable connectors (not shown) mounted on frame 1A and by frame 1B. A clock module 82 indicated in FIGS. 12 and 14 controlled by master computer 35 sends signals to each of LED modules 1–5 for both frame A and frame B by a clock circuit 84. The electrical connection set forth between frame 1A and frame 1B is analogous to the electrical connection between frame 2A and frame 2B; between frame 1A' and frame 1B'; between frame 2A' and frame 2B'; between frame 3A and frame 3B; and between frame 3A' and frame 3B', all as seen in FIG. 10.

Figure 13:
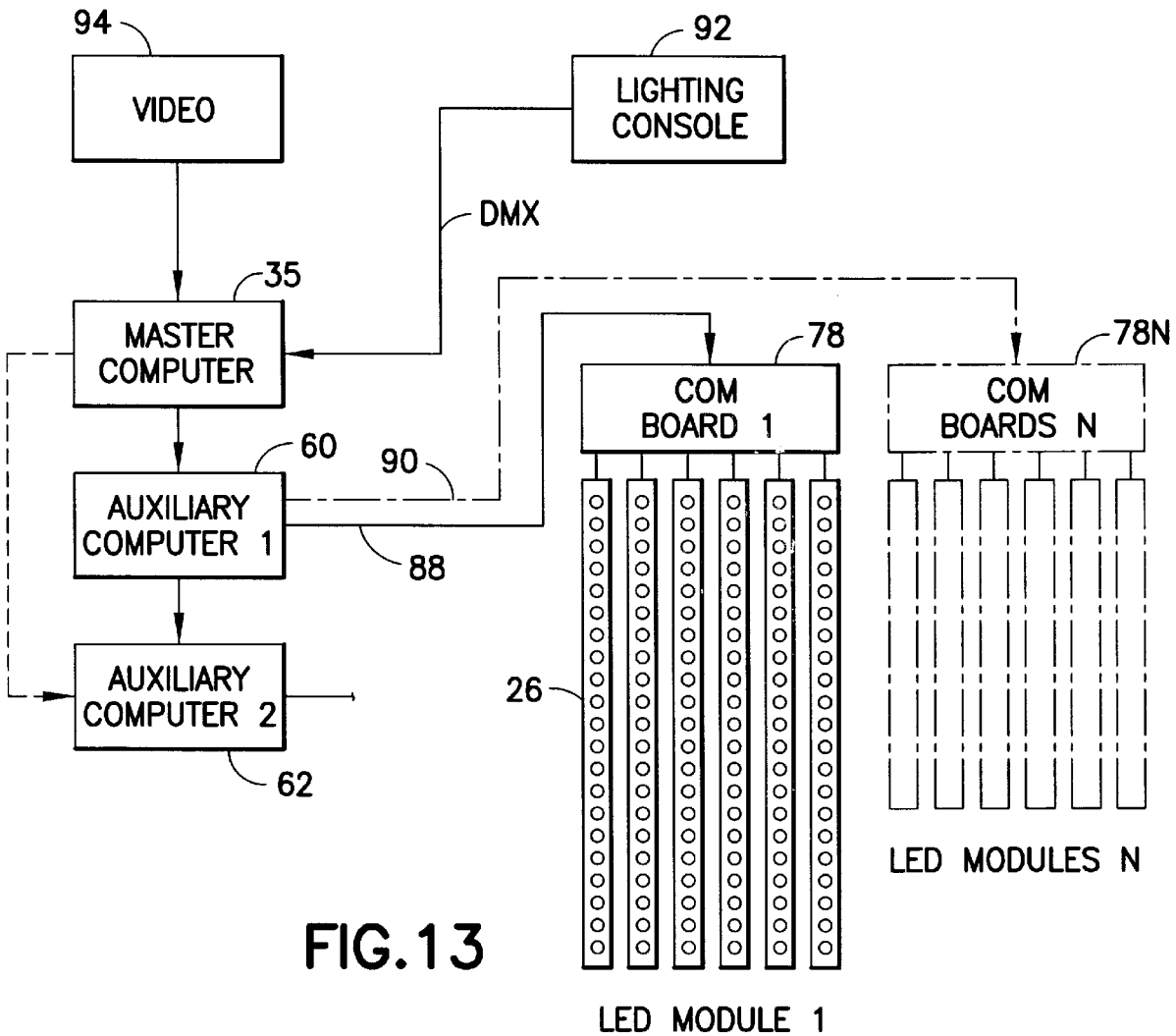
FIG. 13 is an electrical block diagram that shows the operative connection between the master computer and the two auxiliary computers. and the driver boards for one LED module and indicating the other LED modules for one frame of the frame unit shown in FIG. 9.
Figure 14:
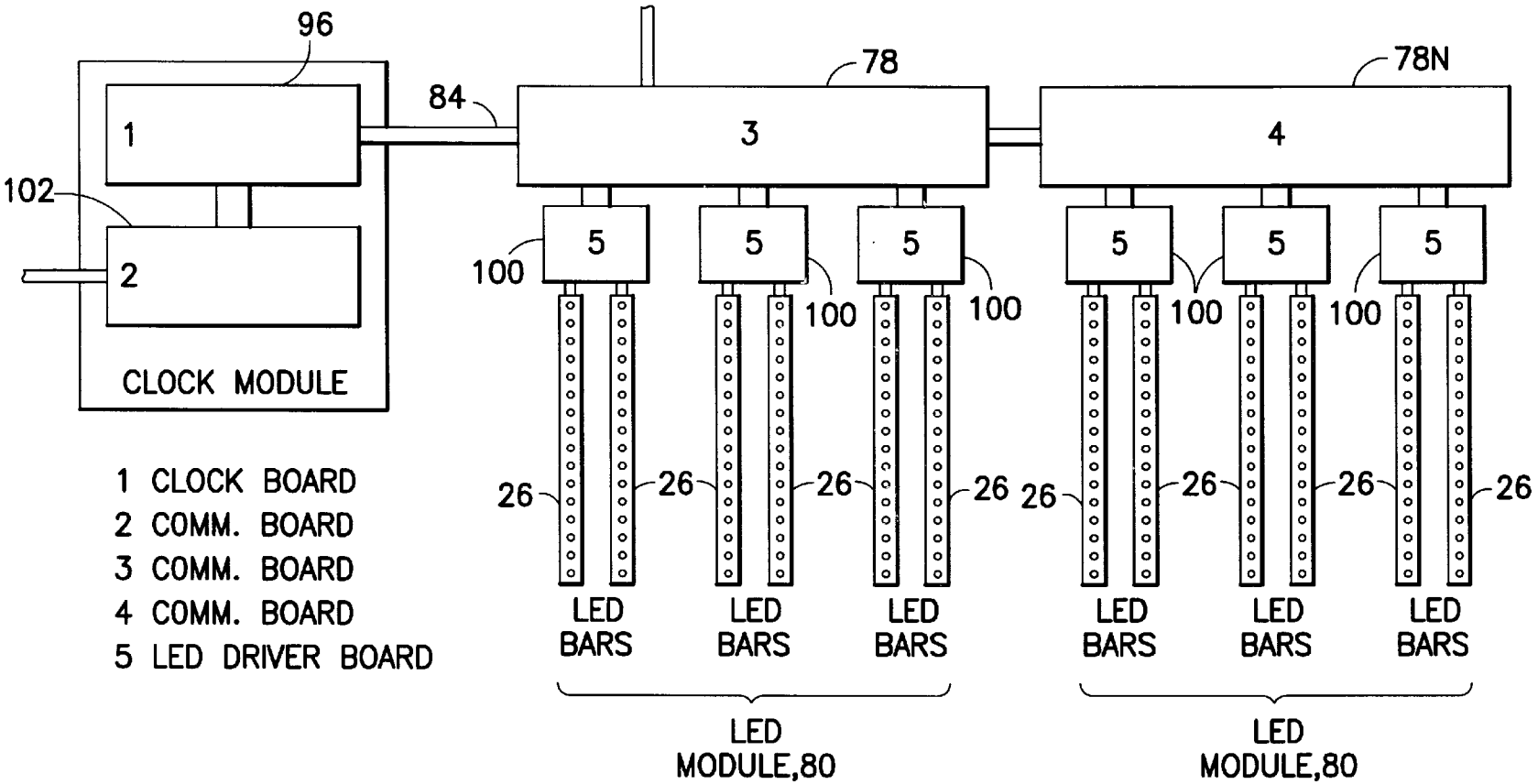
FIG. 14 is an electrical block diagram that shows the operative connection between a clock module and two LED modules with each LED module including one communication board and three driver boards.

FIG. 14 shows in block diagram a portion of a control circuit system that includes master computer 35 operatively connected to auxiliary computers 60 and 62. Master computer 35 is equipped with two faces of memory area that is equivalent to six frames 14 and shares its two memory areas with auxiliary computers 60 and 62. Master computer 35 defines imaging data and shares memory area with auxiliary computers 60 and 62. The imaging data is sent out to both auxiliary computers 60 and 62. Each auxiliary computer 60 and 62 is equipped to provide image data to six frames 14 shown in FIG. 10 for a total of the 12 frames shown. For purposes of exposition relating to exemplary frames 1A and frame 1B as shown in FIG. 12 but as exemplary for all frames 14 as shown in FIG. 10, auxiliary computer 60 is operatively connected to ten LED modules 1–5 for frame 1A and to ten LED modules for frame 1B. Auxiliary computer 60 is in signal communication to an LED communication board 78 for LED module 1 shown in FIG. 13. Modules 2–5 for frame 1A shown in FIG. 12 are indicated in phantom line as modules N in FIG. 13 having communication boards N. In this manner, auxiliary computer 60 controls by auxiliary signal circuit 88 to LED communication boards 78 and by auxiliary circuits 90 to communication boards 78N and its six LED bars 26 together with 5 communication boards N and their related twenty-four LED pixel bars 26. Auxiliary computer 60 controls the LED modules for a total of six frames. Further, in an analogous manner auxiliary computer 62 controls another six frames 14.

FIG. 13 shows a DMX lighting console 82 operatively connected to master by a DMX signal line to computer 35 that has an interface for receiving DMX signals. A video 92 is connected to master computer 35, which has a video capture board to receive video signals from video 94. In order to store bit-mapped pixels, master computer 35 has a memory system like a hard disc and further has the function to successively send out multiple bit-mapped pixels as animation. In order to send out abstract visual images, master computer 35 has a vector calculation function, which is the function to edit and memorize the required parameters for the vector calculation. Master computer 35 interfaces to receive remote DMX control signals from lighting console 92.

In order to store the bit-mapped pixels, master computer 35 has a memory system has a memory system like a hard disc and further has the function to send out bit-mapped pixels as still images and to successively send out multiple bit-mapped pixels as animated images.

Master computer 35 is equipped with two faces of memory area that is equivalent to six LED frames worth of pixelation, and by sharing the memory area with auxiliary computers 60 and 62, it sends out drawing data defined by master computer 35 to auxiliary computers 60 and 62.

Auxiliary computers 60 and 62 function as follows: Each of auxiliary computers 60 and 62 is equipped to control an assigned six LED frames 14 and as each auxiliary computer receives image data defined by master computer 35 and transmits such data by simultaneous signals in serial transfer mode to the assigned LED pixels 28 for display.

FIG. 14 is a block diagram of the operation of typical clock module 76 for a single frame electrical set comprising two LED communication boards 78 shown as communication boards 3 and 4, which are associated with a frame unit typified as frame unit 1 comprising exemplary frames 1A and 1B as shown in FIG. 12. Clock module 84 has a clock board 96 shown as clock board 1 that receives signals from a clock communication board 96 shown as clock communication board 2 in signal communication with master computer 35. Clock board 96 is in signal communication by clock circuit 98 with the two LED communication boards 78. LED communication board 3 is connected to three LED driver boards 100 shown as LED driver boards 5 in FIG. 14; and likewise LED communication board 4 is connected to three LED driver boards 100 shown as LED driver boards 5 in FIG. 14.

The movement of master computer 35 is as follows. As a process stage for the visual data that is displayed has one line of video signal process, two lines of vector calculation visual data process, and two lines of bit-map visual data process. Master computer 35 has two lines of buffer memory which temporarily stores the processed data mentioned. Master computer 35 has the process stage to add the two lines of buffer memory.

Master computer 35 has the following functions:

1) The processing of video signals for master computer 35 is as follows. With reference to video input signals, it is possible to input in NTSC.PAL standard signals. The video signal that has been brought in will be switched to digital signals at the video capture board of master computer 35 and will be written by the video frame unit that is in the video memory. For application, the video memory area is accessed and the display area is selected and after it is compacted to the dissolve capacity for the LED display, buffer memory no.1 is started.
2) The processing the vector calculation data by master computer 35 is as follows. With each previously set pixel as the basic data, the brightness and color balance of each pixel is calculated after the basic unit time. Buffer memory no.1 and no.2 are written. It is possible to make a complex pixel data by editing the parameter used in the calculation.
3) The processing of the bit-map pixel data by master computer 35 is as follows. Photos, illustrations and related materials are first digitized and such digitized data is stored in the hard disc of master computer 35 as bit-map data. When such data is selected it is written the buffer memory no.1 and no.2. Multiple data that has been added with animation attributes will be written successively into the buffer memory.
4) The selection by master computer 35 of the visual data to be displayed and adjustment of the brightness, color balance, speed and other related illumination matters is as follows. The operator can observe the above data while watching the control screen and then decide whether to display the content of either of the two buffer memories or to add and display both. Also, read outs by the operator of brightness, color balance, animation and speed and related factors of the vector calculation allows such data to be freely adjusted.

5) Master computer 35 has a DMX interface with lighting console 92 which has a DMX signal input that allows the selection of displayed visual data and further allows adjustment of brightness, color balance and speed to be done by remote control.

6) The content of displayed data written in the buffer memory is transferred from master computer 35 to auxiliary computers 60 and 62 by writing in the memory shared by master computer 35 with the particular auxiliary computer that handles the displayed area.

The movement of auxiliary computers 60 and 62 is as follows.

1) Data is processed from master computer 35 by auxiliary computers 60 and 62 by the reading of the content of the memory shared with master computer 35 Auxiliary computers 60 and 62 further separates out the LED that corresponds to each pixel 28 by each of frame operational units 76. The data is divided and transferred to the buffer memory that corresponds to each LED driver 100 which divides the data to each of its six LED bar units 26 and to each of their 16 pixels.

2) When the timing of each display screen portion has been written, the data row will be changed so that the serial data can be transferred to the order of the pixel 28 that is lowest of the 16 pixels 28 on LED bar 26 to the highest pixel 28 on LED bar 26.

3) All pixel data will be transferred when a simultaneous signal that is a base to be displayed in the display area occurs.

4) Pixel data and signals that have been changed to serial data is sent out to the display.

The display has the following functions:

1) Clock communications board 102 functions as follows. In order to take the simultaneous time of the serial transfer data with each LED bar unit 26 from the controller, master computer 35, and to precisely display such data, the clock signal that controls each LED driver 28 based on the simultaneous signal that is sent by master computer 35 occurs.

2) Communications board 102 functions as follows. Along with the clock signal, LED driver 28 renews the display data in the order of the lowest pixel 28 as pixel number 1 of the 16 pixels on each pixel bar unit 26 to the highest pixel 28 as pixel number 16. At the time the data for high pixel number 16 is renewed, LED driver board 100 transmits the displayed data at once to pixel number 16 pixel.

In summary the present invention includes control means for receiving external video signals, processing the signals as into memory as still images, processing the still images as multiple image animation data and transferring the animation data to an LED driver for transfer to the pixels as pixel display animation data, the control means including means for processing color separation capacity of the plurality of pixels 28 into a plurality of colors in combination with the pixel display animation data, the plurality of colors including color brightness, color balance and color speed.

The use of three lasers of blue, green and red to combine as a single pixel in controlled combinations to obtain the colors of the visible spectrum is merely one example of the use of lasers in the present invention. Other lasers that can be substituted for the RGB lasers herein described. Tunable lasers are known that can be tuned to emit a plurality of colors. Tunable lasers are expensive but can be used. New types of less expensive lasers include a single laser with a biasable, translucent membrane that is dyed and will emit colors over the visible spectrum when stretched to make shorter or longer wavelengths. Either of the mentioned types of laser can be substituted for the RGB laser pixels described herein.

The size of each frame can vary in accordance with weight and ease of handling, lifting, assembling, disassembling, and transporting. One prototype frame has the following metric dimensions and weight: width: 1800 mm; height: 960 mm; weight: 18 kg. This translates in U.S. equivalents to the following approximate dimensions and weight: width: 5.8 ft.; height: 3.1 ft.; weight: 39.6 lb. These dimensions and weight can vary within the spirit of the invention. These suggested parameters result in the following for display 10 in U.S. equivalents: width: 17.4 ft.; height: 12. ft.; weight per column: 118.2 lb.

The exemplary display ten comprising three stacks, or columns, 16A, 16B, and 16C can vary so as to be four columns, or five columns, or more columns, for example. The number of frames per column can vary from three frames per column to two frames per column or four frames per column, or more frames per column within the spirit of the invention.

The background behind display 10 is visible to an audience because a space exists between pixel support bars 26. The background of display 10 is transmittable to an audience in the range of 70 percent. The ability to transmit such background for audience viewing significantly adds to the stage effect of the invention. This added capacity for stage effect is increased when the pixel lights are off. Thus back light effect behind display 10 is possible.

Figure 15A:
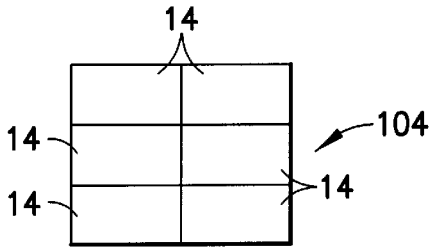
FIG. 15A is a schematic configuration of a frontal view of a matrix LED display analogous to the view shown in FIG. 1 that includes two vertical columns, or stacks, of three frames for each stack for a total of six frames.
Figure 15B:
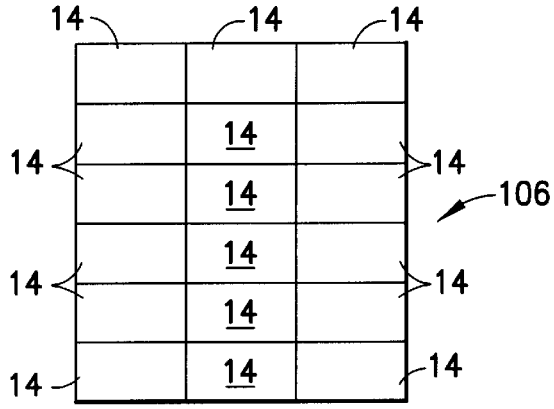
FIG. 15B is a schematic configuration of a frontal view of a matrix LED display analogous to the view shown in FIG. 1 that includes three vertical columns, or stacks, of six frames for each stack for a total of 18 frames.
Figure 15C:
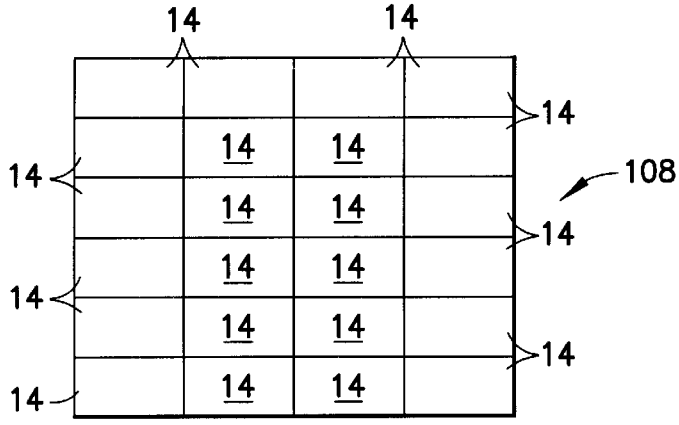
FIG. 15C is a schematic configuration of a frontal view of a matrix LED display analogous to the view shown in FIG. 1 that includes five vertical columns, or stacks, of six frames for each stack for a total of 24 frames.
Figure 15D:
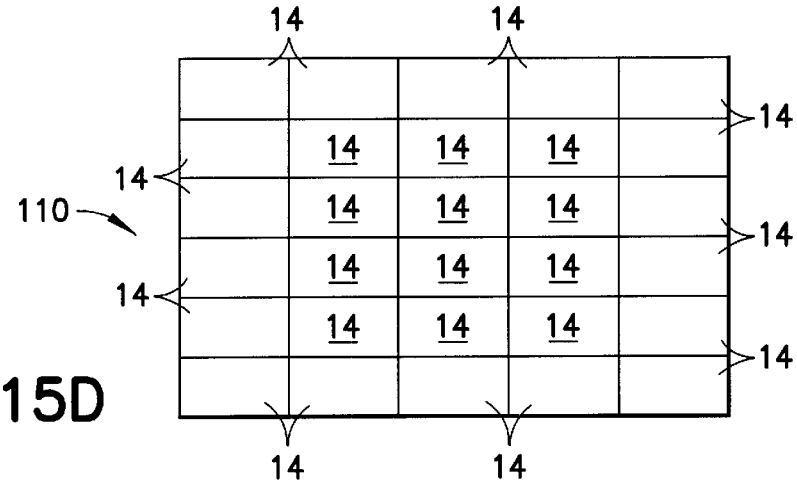
FIG. 15D is a schematic configuration of a frontal view of a matrix LED display analogous to the view shown in FIG. 1 that includes six vertical columns, or stacks, of six frames for each stack for a total of 36 frames.

FIGS. 15A, 15B, 15C and 15D show some alternate configurations of LED display system 10 other than the three stacks 16A, 16B and 16C each having four frames 14 per stack for a total of twelve frames. For example, FIG. 15A indicates in schematic form an LED display system 104 comprising two stacks of frames 14 of three frames 14 per stack for a total of six frames. As another configuration, FIG. 15B indicates in schematic form another LED display system 106 comprising three stacks of frames 14 of six frames 14 per stack for a total of eighteen frames. Another configuration of an LED display system 108 comprising four stacks of frames 14 of six frames 14 per stack for a total of twenty-four frames 14 is shown in FIG. 15C. Still another configuration is LED display system 110 is shown in FIG. 15D which comprises seven stacks of frames 14 of five frames 14 per stack for a total of thirty-five frames. Still other configurations of other analogous LED displays are possible, such as equal number of horizontal rows (side-by-side frames) and stocks with the number of rows and stacks with the number of rows and stacks being an odd/even number. Still other arrangements are possible within the spirit of the invention, which is that of a plurality of free-hanging stacks of frames for the LED image display system described herein.

With regard to the lightweight frames of the display system and with consideration of FIG. 15A, FIG. 1, and FIGS. 15B, 15C and 15D in that order, their weights are 108, 216, 324, 432 and 630 kilograms, respectively (fully assembled).

Figure 16:
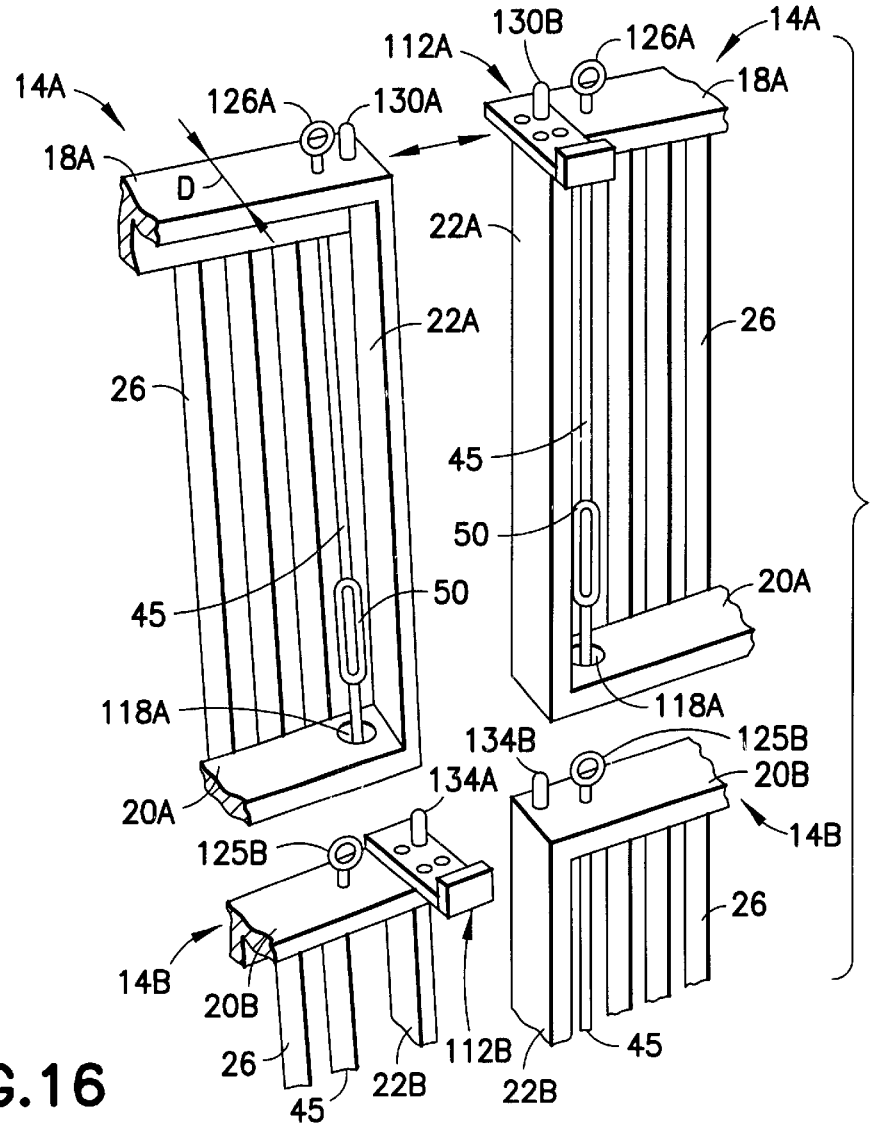
FIG. 16 shows in fragmentary perspective view four frames in preparation for side-by-side connection by side connector plates as an alternate to the frame connector shown in FIG. 9B.
Figure 16A:
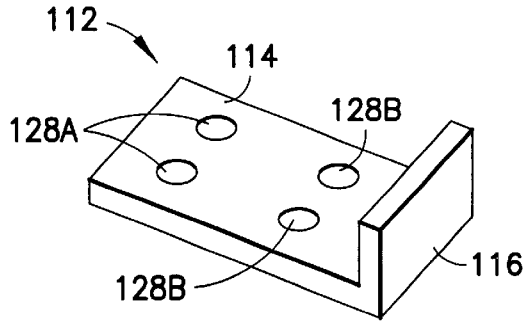
FIG. 16A is an isolated perspective top view of the side connector plates shown in FIG. 16.
Figure 16B:
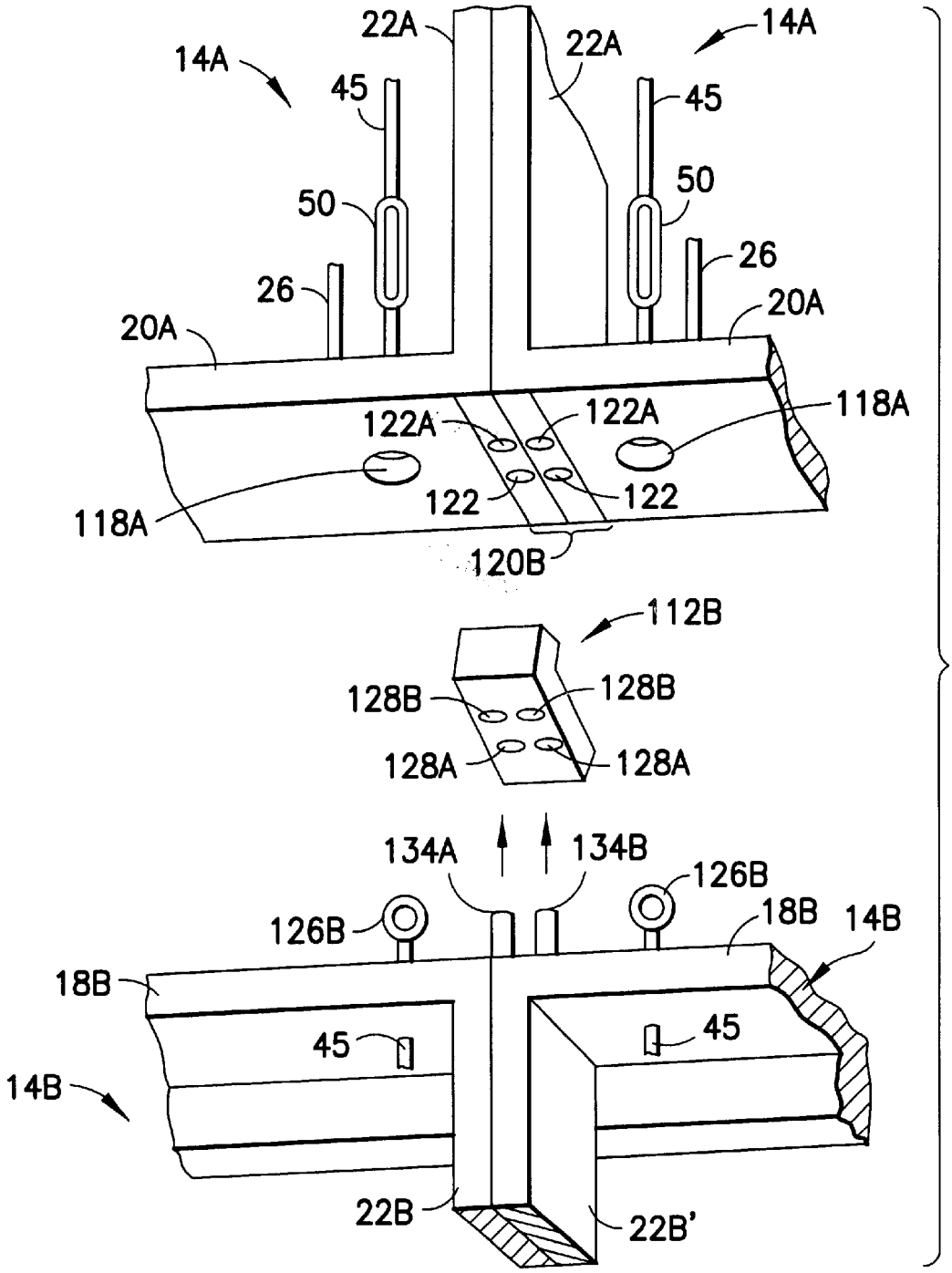
FIG. 16B is a perspective view bottom view of a side connector plate shown in FIGS. 16A and 16B being mounted the four frames shown in FIG. 16.
Figure 17:
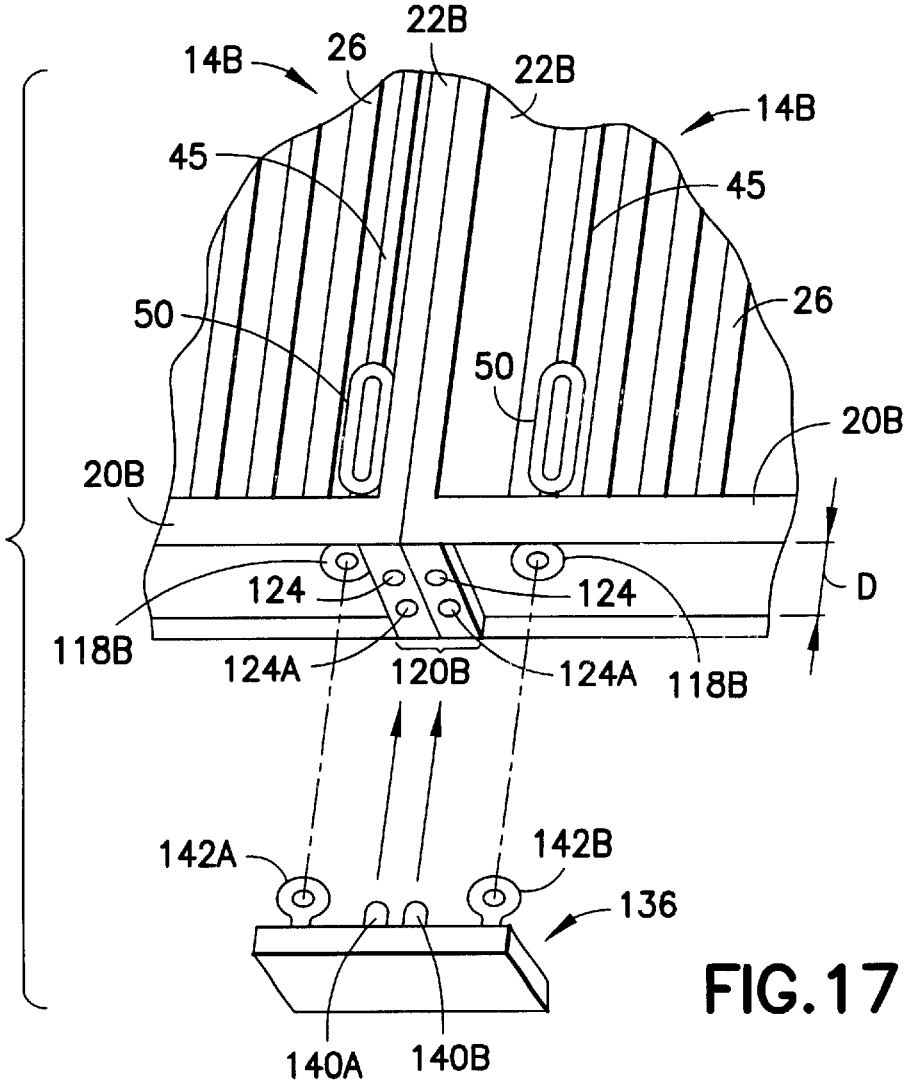
FIG. 17 shows in fragmentary perspective rear view a detail of two lowest frames of an LED display system such as LED display system 10 shown in FIG. 1 positioned side by side with a bottom plate connector ready for final securing to the bottom sides of the two bottom frames.
Figure 17A:
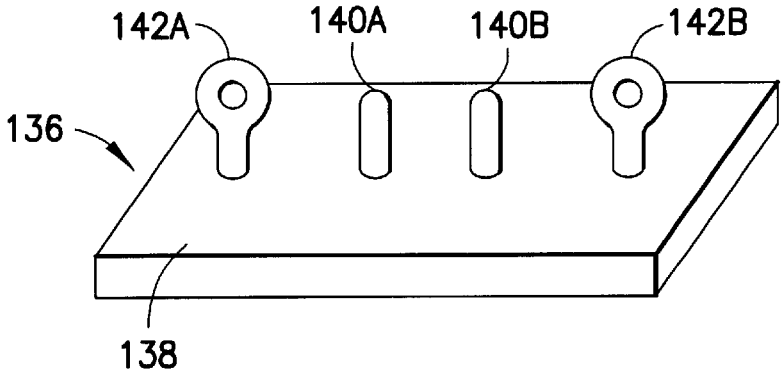
FIG. 17A shows in isolated perspective top view the bottom plate connector shown in FIG. 17.

FIGS. 16, 16A, 16B, 17 and 17B show alternate frame side-by-side connectors to the frame side clamp 64 shown in FIG. 9B. FIG. 16 shows in fragmentary perspective rear views two typical upper frames 14A spaced apart in side-by-side alignment and two typical lower frames 14B also spaced apart in side-by-side alignment in preparation for assembly an LED display system such as LED display system 10. FIG. 17 shows frames 14B in side-by-side alignment with an alternate bottommost connector that will be discussed later below. FIG. 16 now being discussed in particular shows upper frames 14A spaced apart from lower frames 14B. In particular, upper frame sides 22A are spaced from one another and lower frame sides 22B are spaced from one another. Upper frames 14A include top sides 18A and bottom sides 20A and lower frames 16A include top sides 18B and bottom sides 20B so that bottom sides 20A are spaced from top sides 18B. Also shown are pixel support bars generally designated pixel support bars 26 positioned in each of frames 14A and 14B in a manner previously described. Also shown are support rods with turnbuckles described in detail previously and generally designated as support rods 45 with turnbuckles 50 connected to frames 14A and 14B in a manner previously described in detail.

A typical side connector plate 112 shown in isolation in FIG. 16A is shown as upper connector plate 112A placed upon one of top sides 18A of upper frames 14A and shown as a lower side connector plate 112B placed upon one of top sides 18B of lower frames 14B with both connector plates 112A and 112B being positioned as shown in FIG. 6 for purposes of exposition. Each connector plate 112A and 112B as typified by typical side connector plate 112 as seen in FIG. 16A includes an elongated rectangular flat bar portion 114 and a flat upwardly flanged gripping portion 116 connected to the end of bar portion 114 at a perpendicular angle.

Apertures 118A are defined in upper frame bottom sides 20A as described previously herein in relation to apertures 55A. Apertures 118B are defined in lower frame bottom sides 20B as seen in FIG. 17. In addition, side walls 22A have lower areas 120B seen in FIG. 16B each defining a pin hole 122 and an optional pin hole 124A.

Upper connecting rings 126A are shown extending from upper frame top sides 18A, and lower connecting rings 126B are shown extending from lower frame top sides 18B. Upper and lower connecting rings 126A and 126B shown in FIG. 16 are as previously described herein with relation to connecting rings 52A and 52B and are to be secured to hooks (not seen in FIG. 16) such as hooks 54A and 54B connected to support rods 52A and 52B as described earlier herein) proximate to apertures 118A and 118B.

At least two spaced bore holes 128A linearly aligned with the two frames 14A and likewise with the two frames 14B extend perpendicularly through each flat bar portion 114 of each of upper and lower connecting plates 112A and 112B in the final assembled mode. Two optional backup bore holes 128B having the same alignment characteristics as bore holes 128A are also shown extending through each bar portion 114. An upwardly extending holding pin 130A is connected to each top side 18A of frames 14A and an upwardly extending holding pin 130B is connected to each top side 18B of frames 14B. In particular, holding pins 130A and 130B are positioned proximate to each side wall 22A and 22B of frames 14A and 14B, respectively. In the view shown in FIG. 16, upper side connector plate 112A has been placed upon one frame 14A with one holding pin 130A already extending through one bore hole 128A (see FIG. 16A). The holding pin 130A of the other frame 14A will extend through the other aligned bore hole 128A of upper side connector plate 112A. It is to be noted that the view shown in FIG. 16 is shown for purposes of exposition is not as in fact as frames 14A and 14B are assembled, that is to say, upper frames 14A will more efficiently be placed side by side and then connector plate 112A be fitted over both holding pins 130A. The same procedure as described applies also to lower side connector plate 112B with regard to frames 14B. FIG. 16B shows a bottom perspective view of side connector plate 112B in the process of being connected to abutting upper frames 14A and abutting lower frames 14B. A pair of holding pins 134A are about to be passed through bore holes 132A of side connector plate 112B. Furthermore, holding pins 134A are also about to be passed into pin holes 122 defined in the lower areas 120A of side walls 22A of each of upper frames 14A. Optional backup pin holes 122A are also defined in lower areas 120A of side walls 22A. FIG. 17 shows pin holes 124 defined in the lower areas 120B of each of lower frames 14B with optional backup pin holes 124A also defined there.

FIG. 17 shows a bottom side connector plate 136 that is in position for connection to lower frames 14B shown in FIG. 16 that is used in conjuction with side connector plates 112A and 112B shown in FIGS. 16, 16A and 16B. Bottom side connector plate 136 is particularly directed to connecting the lowest LED frames positioned together in side-to-side alignment. FIG. 17 shows in perspective in a partial rear view the two typical lower frames 14B shown in FIG. 16 when the same lower frames 14B represent the bottommost frames shown in LED display system 10 as an example.

Bottom side connector plate 136 is flat and rectangular with a topside 138. Two upwardly extending holding pins 140A and 140B are connected to topside 138 as are two upwardly extending connecting rings 142A and 142B positioned outwardly from holding pins 140A and 140B. Two upwardly extending connecting hooks (not seen) analogous to connecting hooks 54A and 54B described earlier herein) positioned at the bottom of connecting rods 45 are aligned in registry with apertures 118B defined in frame bottom sides 20B. Connecting rings 142A and 142B and holding pins 140A and 140B are arranged in linear alignment with frame bottom walls 20B with holding pin 140A being spaced from connecting ring 142A and holding pin 140B being spaced from connecting ring 142B. As previously mentioned each side wall 22B includes lower area 120B each defining a pin hole 124 and another backup pin hole 124A with pin holes 124 and 124A being paired in linear alignment with each bottom wall 20B. Each connecting ring 142A and 142B is aligned in registry for insertion into lower frame apertures 118B for connection with the hooks positioned in registry with lower frame apertures 118B previously described herein for connection to the hooks connected to the bottom of connecting rods 45.

When all side connector plates 112 and all bottom connector plates 136 are connected to all frames 14 of LED display system 10, for example, relative independent movement of stacks of frames, such as frame stacks 16A, 16B and 16C shown in FIG. 1, is prevented.

Although the present invention has been described in some detail by way of illustration and example for purposes of clarity and understanding, it will, of course, be understood that various changes and modifications may be made in the form, details, and arrangements of the parts without departing from the scope of the invention.

What is claimed is:

1. A large-scale light emitting diode (LED) image display system, comprising:

a plurality of rigid frames positioned in at least one vertical stack so as to form a planar vertical display, wherein said plurality of frames includes a top frame and a bottom frame spaced from the surface, a plurality of vertical rigid bar members mounted to each of said plurality of rigid frames, said bar members being equally spaced apart, a plurality of LED pixels mounted to each of said plurality of bar members, said pixels being equally spaced apart, said LED pixels forming a matrix of pixels, said LED pixels projecting colored light beams defining images, means for bearing the weight of the frames in a tension mode connected to each of said plurality of frames, said means for bearing weight having a top connector and a bottom connector, said top connector of said top frame being for being removably secured to an overhead support, said bottom frame being spaced from the surface, means for removably securing said bottom connector of each stacked frame to said top connector of each below stacked frame, means for tensioning each of said means for bearing weight so as to tightly position all frames of said vertical stack, means for transmitting electrical signals and electrical power to said pixels, and control means for receiving external video signals, processing said signals into memory as still images, processing said still images as multiple image animation data and transferring said animation data to an LED driver for transfer to said pixels as pixel display animation data, said controller means including means for processing color separation capacity of said plurality of said pixels into a plurality of colors in combination with said pixel display animation data, said plurality of colors including color brightness, color balance and color speed.

2. The large-scale display system in accordance with claim 1, wherein each of said plurality of pixels includes a red LED, a blue LED and a green LED wherein the colors of the visible spectrum can be created.

3. The large-scale display system in accordance with claim 1, wherein each individual frame of said plurality of frames includes opposed top and bottom sides, and said means for bearing the weight of the frames is at least one elongated support rod connected to said each individual frame at said top side.

4. The large-scale display system in accordance with claim 3, wherein said at least one support rod is two spaced support rods.

5. The large-scale display system in accordance with claim 3, wherein said at least one support rod has opposed rod top and rod bottom ends, said rod top end having a rod top end connector and said rod bottom end having a rod bottom end connector, said rod top end connector being spaced above said top side of said each individual frame and said rod bottom side connector being spaced above said bottom side of said each individual frame.

6. The large-scale display system in accordance with claim 5, wherein said means for removably securing said bottom connector to said top connector includes said rod bottom end connectors of said plurality of vertical frames being removably connected to said rod top end connectors of said plurality of frames.

7. The large-scale display system in accordance with claim 6, wherein said rod top end connectors are rings and said rod bottom end connectors are hooks.

8. The large-scale display system in accordance with claim 6, wherein each said rod has an rod upper portion and a rod lower portion, and further including a turnbuckle theadably and adjustably connected to said rod upper portion and to said rod lower portion.

9. The large-scale display system in accordance with claim 1, further including a plurality of protective transparent tubes enclosing said plurality of bar members, said plurality of tubes being connected to each of said plurality of frames.

10. The large-scale display system in accordance with claim 8, further including a printed circuit connected to said means for transmitting power and signals mounted to each of said plurality of bar members.

11. The large-scale display system in accordance with claim 1, wherein said control means includes a master computer.

12. The large-scale display system in accordance with claim 11, further including a video and a video capture board operatativly connected to said master computer for receiving video signals from said video.

13. The large-scale display system in accordance with claim 12, wherein said master computer has the function to send out signals to said pixels as still images.

14. The large-scale display system in accordance with claim 12, wherein said master computer has the function to send out signals to said pixels as animated images.

15. The large-scale display system in accordance with claim 11, further including at least one auxiliary computer operatively connected to said master computer for receiving signals from said master computer for transmittal to said pixels.

16. The large-scale display system in accordance with claim 15 wherein said at least one auxiliary computer is two auxiliary computers.

17. The large-scale display system in accordance with claim 11, further including a lighting console operatively connected to said master computer.

18. The large-scale display system in accordance with claim 1, wherein each said frame is configured as a rectangle.

19. The large-scale display system in accordance with claim 18, wherein said planar vertical display is configured as a rectangle.

20. The large-scale display system in accordance with claim 3, further including means for aligning each of said plurality of frames in said at least one stack.

21. The large-scale display system in accordance with claim 20, wherein said means for aligning is at least one vertical pin connected to each of said top sides of each of said plurality of frames and an aperture defined in each of said bottom sides of each of said plurality of frames.

22. The large-scale display system in accordance with claim 1, wherein said at least one vertical stack is a plurality of vertical stacks of frames.

23. The large-scale display system in accordance with claim 22, wherein said plurality of stacks of frames includes a plurality of adjoining frames in adjoining stacks, further including means for holding each of said adjoining frames together.

24. The large-scale display system in accordance with claim 23, wherein said means for holding is at least one clamp holding together each of said side walls of the adjoining frames of said plurality of adjoining frames in each of said plurality of stacks of frames.

25. The large-scale display system in accordance with claim 1, wherein said display system comprises three stacks of frames with each of said stacks having four frames for a total of twelve said frames.

26. The large-scale display system in accordance with claim 1, wherein said display system comprises two stacks of frames with each of said stacks having three frames for a total of six said frames.

27. The large-scale display system in accordance with claim 1, wherein said display system comprises three stacks of frames with each of said stacks having six frames for a total of eighteen said frames.

28. The large-scale display system in accordance with claim 1, wherein said display system comprises four stacks of frames each of said stacks having six frames for a total of twenty-four said frames.

29. The large-scale display system in accordance with claim 1, wherein said display system comprises six stacks of frames each of said stacks having six frames for a total of thirty-six said frames.

30. The large-scale display system in accordance with claim 1, wherein said plurality of frames are made of a thin, lightweight material.

31. The large-scale display system in accordance with claim 3, wherein said material is a lightweight metal.

32. The large-scale display system in accordance with claim 31, wherein said material is a plastic.

33. The large-scale display system in accordance with claim 3, wherein said top and bottom sides of each said plurality of frame are linear.

34. The large-scale display system in accordance with claim 33, where each frame of said plurality of frames includes opposed linear side walls connected to each of said linear top and bottom side walls wherein each said frame is rectangular in configuration.

35. The large-scale display system in accordance with claim 1, wherein said at least one vertical stack is a single stack and said plurality of frames includes two stacked frames.

36. The large-scale display system in accordance with claim 37, further including a plurality of rows and a plurality of stacks, and said rows and stacks total either an odd/even number.

37. The large-scale display system in accordance with claim 1, wherein said plurality of frames total either an odd/even number.

38. The large-scale display system in accordance with claim 1, wherein a plurality of frames disposed side-by-side constitute a row in said display system.

39. The large-scale display system in accordance with claim 23, wherein each said frame includes a top side and an opposed bottom side and opposed side walls joined to said top and bottom sides, said means for holding including a plurality of frame side connectors, each said frame side connector including a connecting plate that is removably secured to each top side of frames of one stack and to each top side of frames of an adjoining stack at said side walls of said frames in side to side association, said connecting plate being further removably positioned with each top side of frames of one stack and each bottom side of frames of the same stack, wherein all said frames of one stack are connected to said frames of each said adjoining stack and all said stacks of said display system are secured in side-by-side connection in the assembled mode of said display system.

40. The large-scale display system in accordance with claim 39, wherein each said top side of each said frame is provided with an upright holding pin proximate at each said side wall of each frame for a total of two holding pins per frame and each said connecting plate includes at least two bore holes in linear aligment with said holding pins, wherein each said connecting plate straddles said adjoining frame side walls and said holding pins extend through said two bore holes in the assembled mode of said display system.

41. The large-scale display system in accordance with claim 40, wherein each said frame side wall has a lower area wherein each said lower area defines a vertical pin hole, said holding pins of each said connecting plate also extending into said pin holes in the assembled mode of said display system.

* * * * *